US010087633B2

(12) United States Patent
Kralic et al.

(10) Patent No.: US 10,087,633 B2
(45) Date of Patent: Oct. 2, 2018

(54) END LAP SYSTEM FOR ROOF CLADDING SHEETS

(71) Applicant: Bluescope Steel Limited, Melbourne, Victoria (AU)

(72) Inventors: John Frank Kralic, Mount Pleasant (AU); Rodney John Gallaty, Glenbrook (AU); Michael Celeban, Leonay (AU)

(73) Assignee: Bluescope Steel Limited, Melbourne, Victoria (AU)

( * ) Notice: Subject to any disclaimer, the term of this patent is extended or adjusted under 35 U.S.C. 154(b) by 0 days.

(21) Appl. No.: 14/443,577

(22) PCT Filed: Nov. 15, 2013

(86) PCT No.: PCT/AU2013/001325
§ 371 (c)(1),
(2) Date: May 18, 2015

(87) PCT Pub. No.: WO2014/075149
PCT Pub. Date: May 22, 2014

(65) Prior Publication Data

US 2015/0292209 A1 Oct. 15, 2015

(30) Foreign Application Priority Data

Nov. 16, 2012 (AU) ..... 2012905046
Mar. 15, 2013 (AU) ..... 2013900906

(51) Int. Cl.
*E04D 1/36* (2006.01)
*E04D 3/365* (2006.01)
(Continued)

(52) U.S. Cl.
CPC ..... *E04D 1/36* (2013.01); *E04D 3/362* (2013.01); *E04D 3/365* (2013.01); *E04D 3/3607* (2013.01);
(Continued)

(58) Field of Classification Search
CPC E04D 1/36; E04D 1/02; E04D 1/3405; E04D 13/155; E04D 13/16; E04D 13/165;
(Continued)

(56) References Cited

U.S. PATENT DOCUMENTS 429,937 A * 6/1890 Mitchell ..... C04B 37/026 256/21
2,424,410 A * 7/1947 Miles ..... E04D 3/365 52/478
(Continued)

FOREIGN PATENT DOCUMENTS

AU 2009202866 A1 2/2010
EP 0106993 A2 5/1984
(Continued)

OTHER PUBLICATIONS

International Search Report for PCT/AU2013/001325 dated Mar. 27, 2014 (6 pages).
(Continued)

*Primary Examiner* — Robert Canfield
(74) *Attorney, Agent, or Firm* — Michael Best & Friedrich LLP

(57) ABSTRACT

A clip (61) for holding together an upper roof cladding sheet (29*a*) and a lower roof cladding sheet (29*b*) in an end to end, i.e. end lap, relationship on a roof. The clip is formed to fit over and lock onto a rib (31) of the lower cladding sheet and to retain the upper sheet on the clip. An elongate weather strip (57) is formed from a compressible material and includes a pan section (81) that can fill a gap between
(Continued)

overlapping pans of the cladding sheets. The pan section includes an upper surface having a series of troughs (87) and ridges (89) along the length of the pan section that has the result of providing the pan section with a variable height along the length of the pan section. The ridges of the pan section compress when the upper roof cladding sheet is positioned on and engaged with the lower cladding sheet in an overlapping relationship with the pan section filling the gap between the cladding sheets.

7 Claims, 19 Drawing Sheets

(51) Int. Cl.
*E04D 13/16* (2006.01)
*E04D 1/34* (2006.01)
*E04D 3/36* (2006.01)
*E04D 3/362* (2006.01)

(52) U.S. Cl.
CPC .. *E04D 13/1656* (2013.01); *E04D 2001/3408* (2013.01); *E04D 2001/3432* (2013.01); *E04D 2001/3441* (2013.01); *E04D 2001/3444* (2013.01); *E04D 2001/3488* (2013.01)

(58) Field of Classification Search
CPC ..... E04D 3/362; E04D 3/36076; E04D 2001/3488; E04D 2001/3432; E04D 1/365; E04D 3/3607; E04D 3/3608; E04D 3/365
USPC ..... 52/478, 520, 525, 537, 543, 544, 546, 52/547, 551, 555, 506.05, 508, 512
See application file for complete search history.

(56) References Cited

U.S. PATENT DOCUMENTS 2,787,349 A 4/1957 Kretschmar
2,853,330 A * 9/1958 Harry ..... E04B 1/68 277/649
3,228,495 A 1/1966 Hazell
3,302,357 A 2/1967 Scott
3,385,018 A * 5/1968 Harry ..... E04D 3/3607 277/649
3,812,636 A * 5/1974 Albrecht ..... E04D 3/30 52/220.4
3,945,158 A * 3/1976 Simpson ..... E04D 13/1656 52/22
4,014,148 A * 3/1977 Harter ..... E04D 3/38 52/403.1
4,017,090 A * 4/1977 Cohen ..... E04C 2/322 277/631
4,027,447 A * 6/1977 Granger ..... E04D 3/28 428/185
4,285,182 A * 8/1981 Dinges ..... E04D 3/363 52/478
4,400,922 A * 8/1983 Boyer ..... E04D 3/3607 52/394
4,401,705 A * 8/1983 Ewert ..... E04D 3/3607 428/131
4,406,106 A * 9/1983 Dinges ..... E04D 3/363 428/63
4,463,533 A * 8/1984 Mullet ..... E04D 3/352 52/394
4,466,224 A * 8/1984 Hague ..... E04D 3/3602 52/404.2
4,467,582 A * 8/1984 Hague ..... E04D 3/363 52/419
4,486,998 A * 12/1984 Hague ..... E04D 3/3607 52/478
4,655,020 A * 4/1987 Ginn, Jr. ..... E04D 3/38 52/521
4,676,042 A * 6/1987 Bell, III ..... E04D 3/3602 52/478
4,691,491 A * 9/1987 Lilley ..... E04D 3/3602 52/22
4,747,249 A * 5/1988 Bell, III ..... E04D 3/3602 52/404.1
4,791,770 A * 12/1988 Bell, III ..... E04D 3/3602 52/428
5,287,670 A * 2/1994 Funaki ..... E04D 3/3608 52/478
5,367,848 A * 11/1994 McConnohie ..... E04D 3/3608 52/334
5,390,453 A * 2/1995 Untiedt ..... E04C 3/07 52/478
5,561,953 A * 10/1996 Rotter ..... E04D 3/30 454/365
5,600,971 A * 2/1997 Suk ..... E04D 3/3608 52/470
5,636,488 A * 6/1997 Lawrence ..... E04D 3/3602 52/478
5,692,352 A * 12/1997 Simpson ..... E04C 3/08 52/520
5,855,101 A * 1/1999 Schulte ..... E04D 3/3608 52/506.05
6,052,961 A * 4/2000 Gibbs ..... E04D 1/16 52/518
6,079,166 A * 6/2000 Mason ..... E04D 13/174 454/365
D465,992 S * 11/2002 Sarig ..... E04D 13/1656 D8/354
6,543,197 B2 * 4/2003 Wetzel, III ..... E04B 1/34315 52/581
6,931,796 B2 * 8/2005 Adriaansen ..... E04C 2/543 52/200
7,104,020 B1 * 9/2006 Suttle ..... E04D 3/366 52/478
7,174,686 B1 * 2/2007 Legband ..... E04D 3/3608 52/462
8,806,823 B2 * 8/2014 Polumbus ..... E04D 3/38 52/198
2004/0148898 A1 * 8/2004 Hick ..... E04D 1/34 52/580
2004/0177582 A1 * 9/2004 Adriaansen ..... A01G 9/1438 52/537
2006/0236646 A1 * 10/2006 Nahmias ..... E04D 3/3607 52/716.1

FOREIGN PATENT DOCUMENTS

GB 956397 A 4/1964
JP 1-178651 * 7/1989
JP 1-178653 * 7/1989
JP 2001349010 A * 12/2001

OTHER PUBLICATIONS

International Preliminary Report on Patentability for PCT/AU2013/001325 dated Mar. 15, 2015 (29 pages).

* cited by examiner

END LAP SYSTEM FOR ROOF CLADDING SHEETS

TECHNICAL FIELD

The present invention relates to an end lap system for holding roof cladding sheets in end to end relationship on a roof.

More particularly, but by no means exclusively, the present invention relates to (a) the end lap system, (b) components of the system, including an end lap clip and a weather strip, and (c) a method of installing roof cladding sheets on a roof using the end lap system.

BACKGROUND ART

The term "roof cladding sheets" is understood herein to mean sheets that include one or more parallel ribs with opposed sides, pan sections, and side edge formations that enable the sheets to be positioned side by side in overlapping relationship. Roof cladding sheets may be roll-formed from painted or unpainted steel strip or formed from extruded aluminium or plastics material.

It is known to secure roof cladding sheets to an underlying roof support structure, such as roof purlins, by fastening the sheets directly to the underlying structure using fasteners, such as roofing nails and screws, which pierce the sheets and penetrate the underlying structure. These sheets are commonly referred to as "pierce-fixed" sheets.

It is also known to secure roof cladding sheets to an underlying structure by using clips that are secured to the structure by fasteners and are formed to extend into the ribs of the sheets and include retaining members or tabs that can engage re-entrant portions of the ribs and thereby retain the sheets to the clips. These clips are often preferred because they enable concealed fixing of cladding sheets to an underlying structure. Roof cladding sheets that are secured via these concealed fixing clips are preferable to pierce-fixed sheets in situations where there is a need for improved aesthetics, improved weather resistance, improved security, and greater sheet lengths without end jointing by allowing thermal movement to occur between the roof cladding sheets and the clips. The Lysaght Klip-Lok (Registered Trade Mark) 700HS type roof cladding sheet is an example of one type of roof cladding sheet that is suitable for use with these concealed fixing clips.

In use, the concealed fixing retaining clips are secured to an underlying structure at spaced intervals related to the spacing between the ribs of the cladding sheets. Thereafter, roof cladding sheets are positioned on the clips in overlapping side by side relationship by successively pressing the sheets down onto the clips so that the sides of the ribs are initially forced outwardly to allow the re-entrant portions of the ribs to pass over the retaining members and then snap inwardly into engagement with the retaining members.

The installation of roof cladding sheets to form a roof involves the placement of sheets in side by side overlapping relationship across a section of the roof and in end to end relationship along the length of the roof in situations where roof cladding sheets are not sufficiently long and wide to cover a required roof area.

The present invention is concerned with holding roof cladding sheets in end to end relationship on a roof in a way that locates sheets securely on the roof and provides an effective weather seal.

The above references to the background art do not constitute an admission that the art forms a part of the common general knowledge of a person of ordinary skill in the art. The above references are also not intended to limit the application of the end lap system and components of the end lap system as disclosed herein.

SUMMARY OF THE DISCLOSURE

In general terms, the present invention provides (a) an end lap system for holding an upper roof cladding sheet and a lower roof cladding sheet in end to end relationship on a roof with the upper sheet overlapping the lower sheet, (b) components of the end lap system, including an end lap clip and a weather strip, and (c) a method of installing roof cladding sheets on a roof using the end lap system.

In accordance with the definition provided above, the term "roof cladding sheet" is understood herein to mean a sheet that includes one or more parallel ribs with opposed sides, pan sections, and side edge formations that enable the sheets to be positioned side by side in overlapping relationship.

More particularly, the present invention provides a clip for holding together an upper roof cladding sheet and a lower roof cladding sheet in an end to end, i.e. end lap, relationship on a roof with the upper cladding sheet overlapping the lower cladding sheet, and with the clip being formed so that it can (a) be retained on a rib of the lower cladding sheet and (b) retain the upper cladding sheet on the clip.

More particularly, the present invention provides a clip for holding together an upper roof cladding sheet and a lower roof cladding sheet in an end to end, i.e. end lap, relationship on a roof with the upper cladding sheet overlapping the lower cladding sheet, with the clip being formed (a) to fit over and lock onto a rib of the lower cladding sheet and (b) to retain the upper cladding sheet on the clip.

The clip may be formed so that a rib of the upper cladding sheet can fit over and lock onto the clip.

The clip may have a top wall and a pair of legs that extend downwardly from opposite sides of the top wall.

The clip may be formed so that the legs act resiliently to snap fit over and thereby lock onto the rib of the lower cladding sheet. By way of example, the clip may be formed to deform resiliently outwardly as the clip is fitted over the rib and return to an original position when the clip is in a lock position on the rib.

The top wall may include a formation, such as a downwardly-extending tab, for contacting an upper section of the rib of the lower cladding sheet to space the top wall above the rib.

The legs may include re-entrant portions that are formed to extend into inwardly formed channels defined by re-entrant portions of the rib of the lower cladding sheet and thereby facilitate locking the clip onto the rib when the clip is fitted over the rib.

The leg re-entrant portions and the top wall formation may be formed to contact the rib of the lower cladding sheet and cooperate together to lock the clip onto the rib when the clip is fitted over the rib.

Each leg may have a section that conforms to the shape of a section of the rib of the lower cladding sheet that is above the re-entrant section of the rib of the lower cladding sheet.

Each leg may include an out-turned foot for contacting a pan of the lower cladding sheet when the clip is fitted over and locked onto the rib of the lower cladding sheet.

The upper cladding sheet may be formed to snap fit over and thereby lock onto the clip.

The clip may include a pair of opposed outwardly extending formations, such as tabs, for engaging opposed internal re-entrant sections of a rib of the upper cladding sheet to retain the upper sheet on the clip with the upper cladding sheet being locked onto the clip when the rib of the upper cladding sheet is positioned on the clip.

The formations may extend outwardly from the top wall.

The formations may be cut-out sections of the legs and extend outwardly from the top wall.

The clip may include one or more than one reinforcing rib in the top wall.

The reinforcing rib or ribs may extend a part of the way or all the way across the top wall.

The reinforcing rib or ribs may extend across the top wall and at least partly into the formations for engaging opposed internal re-entrant sections of the rib of the upper cladding sheet.

The reinforcing rib or ribs may extend across the top wall from one leg to the other leg.

The reinforcing rib or ribs may extend across the top wall from one leg to the other leg and partly into the formations for engaging opposed internal re-entrant sections of the rib of the upper cladding sheet.

The clip may include an opening in the top wall to allow a fastener to be inserted through the opening to secure the clip and the lower cladding sheet together or to secure the clip and the lower cladding sheet to a support structure, such as a roof purlin.

The clip may include a plurality of openings in the top wall to allow a plurality of fasteners to be inserted through the openings to secure the clip and the lower cladding sheet together and/or to secure the clip and the lower cladding sheet to a support structure, such as a roof purlin.

The clip may include an opening in one or both legs to allow a fastener to be inserted through the opening to secure the clip and the lower cladding sheet together or to secure the clip and the lower cladding sheet to a support structure, such as a roof purlin.

The clip may include a plurality of openings in one or both legs to allow a plurality of fasteners to be inserted through the openings to secure the clip and the lower cladding sheet together or to secure the clip and the lower cladding sheet to a support structure, such as a roof purlin.

The openings in the top wall and the legs may be offset in a length direction of the clip so that there is no interference between fasteners.

The clip may be formed so that the upper and lower cladding sheets can slide in a lengthwise direction relative to each other when the clip is retained on the rib of the lower cladding sheet and the upper cladding sheet is retained on the clip. The above-described clip with the top wall and the pair of legs that extend downwardly from opposite sides of the top wall and other features is one construction that may allow relative sliding movement.

The clip may be made from sheet steel or any other suitable material. For example, the clip may be made from aluminium or a plastics material. The steel may be G300 or G550 steel.

The clip may be any suitable length and any suitable height.

The present invention also provides an elongate weather strip for at least partially filling a space between an upper roof cladding sheet and a lower roof cladding sheet in an end to end, i.e. end lap, relationship on a roof, the weather strip being formed from a compressible material and including a pan section that in use is positioned in and fills a gap between overlapping pans of the cladding sheets, with the pan section including an upper surface having a series of troughs and ridges along the length of the pan section that provide the pan section with a variable height along the length of the pan section, whereby in use the ridges of the pan section compress when the upper cladding sheet is positioned on and engaged with the lower cladding sheet in an overlapping relationship with the pan section at least partially filling the gap between the overlapping pans of the cladding sheets.

The upper surface may be a scalloped surface.

The upper surface of the pan section of the elongate weather strip makes it possible to use lower forces to position the upper cladding sheet, which typically has pans that have a flat under surface, onto the lower cladding sheet and nevertheless fill the gap between the overlapping pans of the cladding sheets than would be required if the pan section of the weather strip had a constant height.

It is noted that there may be situations where it is not necessary for the weather strip to completely fill the space between the upper cladding sheet and the lower cladding sheet.

The pan section may have a lower surface that has the same profile as the transverse profile of the pan of the lower cladding sheet.

The weather strip may include a rib section that in use is positioned in a gap between overlapping pairs of ribs of the cladding sheets.

The rib section may be formed to completely fill the gap between overlapping pairs of ribs of the cladding sheets.

The rib section may have an upper surface that has the same profile as the transverse profile of the rib of the lower cladding sheet.

The rib section may be formed to only partially fill the gap between overlapping pairs of ribs of the cladding sheets so that air can flow through the remaining part of the gap from one side to the other side of the weather strip. This arrangement makes it possible for air flow to vent trapped moisture.

The rib section may have an upper surface that has a different profile to the transverse profile of the rib of the lower cladding sheet.

The rib section may have a lower surface that has the same profile as the transverse profile of the rib of the lower cladding sheet.

The width of the weather strip may be selected to be sufficiently wide to minimise any risk of the weather strip being displaced from a selected operative position, for example by being pushed over onto its side, while installing the upper cladding sheet onto the lower cladding sheet or by being pushed or rolled over during differential thermal movement of the two overlapping cladding sheets.

The present invention also provides an elongate weather strip for at least partially filling a space between an upper roof cladding sheet and a lower roof cladding sheet in an end to end, i.e. end lap, relationship on a roof, the weather strip being formed from a compressible material and including a rib section that in use is positioned in a gap between overlapping pairs of ribs of the cladding sheets, the rib section being formed to only partially fill the gap between overlapping pairs of ribs of the cladding sheets so that air can flow through the remaining part of the gap from one side to the other side of the weather strip.

The rib section may have a lower surface that has the same profile as the transverse profile of the rib of the lower cladding sheet.

The weather strip may include a pan section that in use is positioned in a gap between overlapping pans of the cladding sheets, with the pan section including an upper surface having a series of troughs and ridges along the length of the pan section that provide the pan section with a variable height along the length of the pan section, whereby in use the ridges of the pan section compress when the upper cladding sheet is positioned on and engaged with the lower cladding sheet in an overlapping relationship with the pan section at least partially filling the gap between the overlapping pans of the cladding sheets.

The present invention also provides an end lap system that holds together an upper roof cladding sheet and a lower roof cladding sheet in an end to end, i.e. end lap, relationship on a roof with the upper sheet overlapping the lower sheet, and with the end lap system including the above-described clip retained on a rib of the lower cladding sheet and retaining the upper cladding sheet on the clip.

In a situation where the cladding sheets have a plurality of ribs, the end lap system may include a plurality of the clips retained on the ribs of the lower cladding sheet.

The system may include the above-described weather strip at least partially filling a gap between the upper and the lower cladding sheets.

The system may include the above-described weather strip at least partially filling a gap between the upper and the lower cladding sheets on one side of the clip or clips and another one of the above-described weather strip at least partially filling a gap between the upper and the lower cladding sheets on the opposite side of the clip or clips.

In a situation where there is a plurality of upper cladding sheets in side by side overlapping relationship and a plurality of lower cladding sheets in side by side overlapping relationship and the upper and lower cladding sheets are in an end to end, i.e. end lap, relationship, the system may include (a) a line of the above-described clips, (b) a line of the above-described weather strips at least partially filling a gap between the upper and the lower cladding sheets on one side of the line of clips and (c) another line of the above-described weather strips at least partially filling a gap between the upper and the lower cladding sheets on the opposite side of the line of clips.

The construction of the weather strip and the position of the weather strip in relation to the clip may be selected to facilitate engagement of the upper cladding sheet on the clip by acting as a cushion that prevents excessive downward force on the clip that could damage the clip and the lower cladding sheet when the upper cladding sheet is pushed down onto the clip.

The present invention also provides a roof that includes a plurality of roof cladding sheets in side by side relationship and end to end relationship, with the above-described end lap system connecting together at least two roof cladding sheets in end to end overlapping relationship.

The present invention also provides a method of installing roof cladding sheets in end to end overlapping relationship on a roof using the above-described end lap system that includes the steps of:

(a) laying a lower cladding sheet onto an underlying roof support structure;
(b) positioning the above-described clip on a rib of the lower cladding sheet;
(c) fastening the clip to the rib of the lower cladding sheet; and
(d) laying an upper cladding sheet in end to end overlapping relationship onto the lower cladding sheet with an overlapping section of the upper cladding sheet being retained on the clip.

Step (a) may include laying the lower cladding sheet onto the underlying roof support structure using any suitable concealed fixing clip, such as conventional concealed fixing clips.

Step (c) may include fastening the clip and the lower cladding sheet to the underlying structure using any suitable fasteners.

The method may include positioning a weather strip across the upper section of the lower cladding sheet on one side on the clip before step (d) of laying the upper cladding sheet in end to end overlapping relationship with the lower cladding sheet.

The method may include positioning another weather strip across the upper section of the lower cladding sheet on the opposite side of the clip before step (d) of laying the upper cladding sheet in end to end overlapping relationship with the lower cladding sheet.

The weather strip may be the above described weather strip.

The present invention also provides a method of installing a plurality of roof cladding sheets in end to end overlapping relationship on a roof using the above-described end lap system that includes the steps of:

(a) laying a plurality of lower cladding sheets onto an underlying roof support structure in side by side overlapping relationship;
(b) positioning a plurality of the above-described clip on ribs of the lower cladding sheet and forming a line of clips;
(c) fastening the clips to the ribs of the lower cladding sheets; and
(d) laying a plurality of upper cladding sheets in side by side overlapping relationship and in end to end overlapping relationship onto the lower cladding sheets with overlapping sections of the upper cladding sheets being retained on the clips.

Step (a) may include laying the lower cladding sheets onto the underlying roof support structure using any suitable concealed fixing clip, such as conventional concealed fixing clips.

Step (c) may include fastening the clips and the lower cladding sheets to the underlying structure.

The method may include positioning a plurality of weather strips across the upper section of the lower cladding sheet on one side on the line of clips in a continuous line before step (d) of laying the upper cladding sheets in end to end overlapping relationship with the lower cladding sheets.

The method may include positioning another a plurality of weather strips across the upper section of the lower cladding sheets on the opposite side of the line of clips before step (d) of laying the upper cladding sheets in side by side overlapping relationship and in end to end overlapping relationship with the lower cladding sheets.

The weather strip may be the above described weather strip.

The weather strips in one line may be longitudinally off-set with respect to the weather strips on the other line so that there is not a direct line between the partially filled gaps between overlapping pairs of ribs of the cladding sheets on opposite sides of the line of clips. The resultant tortuous path for air flow minimises condensation in the space between upper and lower cladding sheets.

The method may include turning up the pans of the lower cladding sheet and turning down the pans of the upper cladding sheet. The turn-up may be done after step (c) and prior to the installation of the weather strip. The turn-down may be done prior to step (d).

BRIEF DESCRIPTION OF THE DRAWINGS

Notwithstanding any other forms which may fall within the scope of the end lap system and components of the end lap system of the invention as set forth in the Summary, a specific embodiment will now be described, by way of example only, with reference to the accompanying drawings of which.

DESCRIPTION OF EMBODIMENTS

Figure 1:
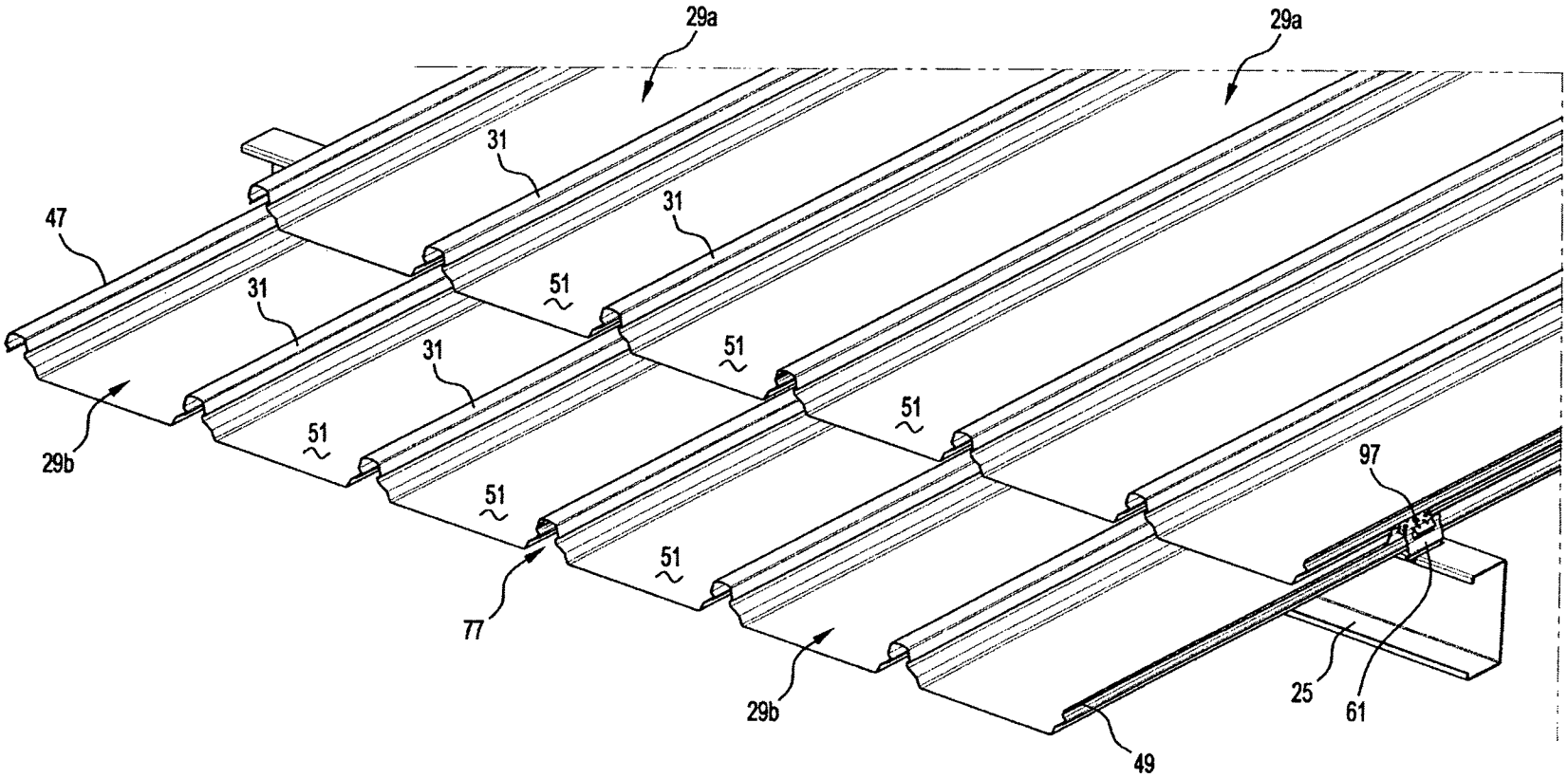
FIG. 1 is a perspective view of a section of a roof that includes two lower roof cladding sheets secured to a roof purlin and two upper roof cladding sheets positioned on and held in end to end relationship with the lower cladding sheets by one embodiment of an end lap system in accordance with the present invention.

FIG. 1 illustrates a section of a roof formed from two upper roof cladding sheets 29*a* and two lower roof cladding sheets 29*b*. The upper sheets 29*a* are in side by side overlapping relationship. The lower sheets 29*b* are in side by side overlapping relationship. The lower sheets 29*b* are in end to end relationship with the upper sheets 29*a*.

The roof cladding sheets 29*a*, 29*b* are identical and are positioned together in end to end overlapping relationship with the lower end of the upper sheets 29*q* overlapping the upper end of the lower sheets 29*b* using one embodiment of an end lap system in accordance with the invention.

A substantial part of the end lap system is hidden in FIG. 1 as a consequence of the upper cladding sheets 29*a* being positioned on the lower cladding sheets 29*b* in the Figure.

The details of the end lap system are shown in more detail in FIGS. 2-9. The end lap system includes:

(a) a plurality of end lap clips 61 (only one of which is visible on the right hand side of FIG. 1) that are retained on the lower cladding sheets 29*b* and retain the upper cladding sheets 29*a* to the lower cladding sheets 29*b* at the overlap of the roof cladding sheets 29*a*, 29*b*; and (b) a weather strip 57 (not visible in FIG. 1 but shown in other Figures) that at least partially fills a space between the roof cladding sheets 29*a*, 29*b* at the overlap of the roof cladding sheets 29*a*, 29*b* and thereby forms a weather barrier.

With reference to FIGS. 1 and 6-9, each cladding sheet 29*a*, 29*b* is roll-formed from corrosion resistant metal coated sheet steel and optionally includes a painted outer coating and includes (a) a leading edge 47, (b) a trailing edge 49, (c) two parallel lengthwise extending ribs, generally identified by the numeral 31, and (d) three parallel lengthwise extending pans 51 on opposite sides of the ribs 31. The cladding sheets 29*a*, 29*b* may be of any suitable length and width and may include any suitable number of ribs 31 separated by pans 51. The invention is not concerned with the particular profile of the cladding sheets 29*a*, 29*b*.

Figure 3:
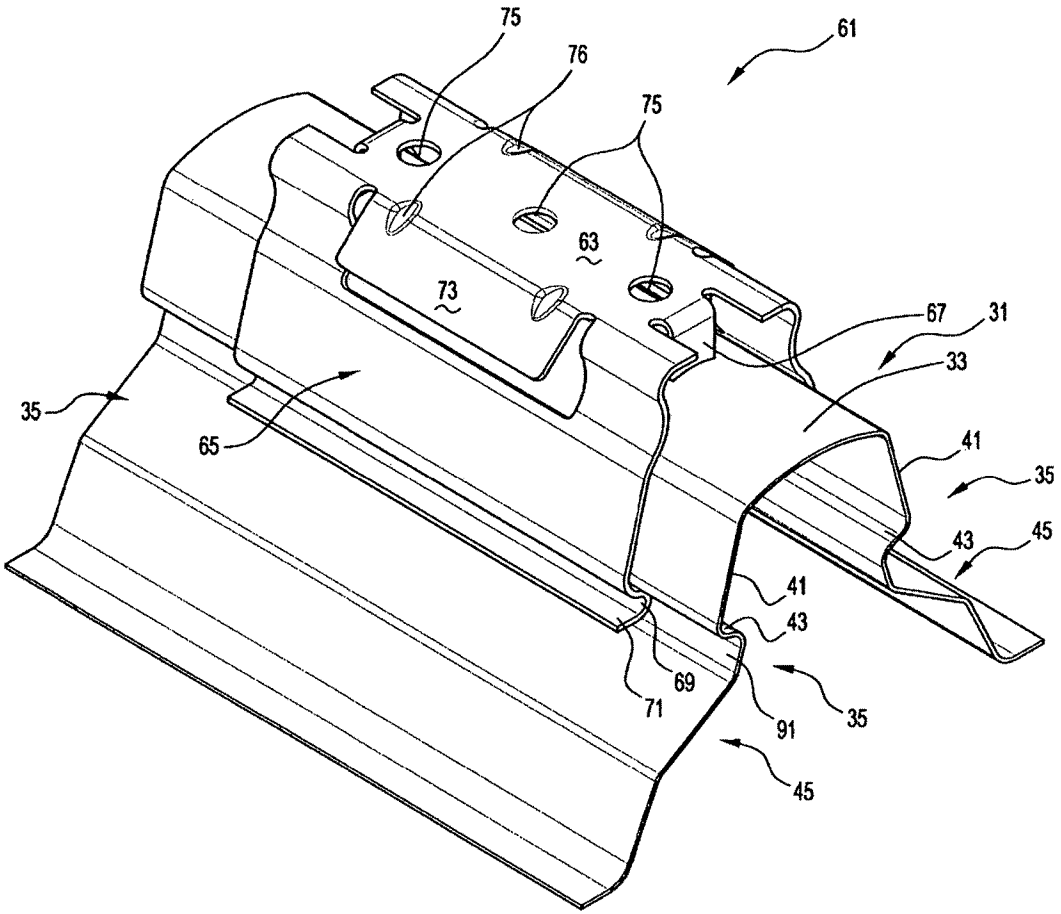
FIG. 3 is an enlarged perspective view of a part of FIG. 1 which shows in detail the end lap clip shown in FIG. 2 positioned on one of the ribs of a lower roof cladding sheet.

As can best be seen in FIG. 3, each rib 31 of the cladding sheets 29*a*, 29*b* includes two sides, generally identified by the numeral 35, that are separated by a convex upper section 33. Each side 35 includes (a) a section 41 that extends outwardly and downwardly from the upper section 33, (b) a section 43 that extends downwardly and inwardly from the lower edge of the section 41, and (c) a section 45 that extends downwardly and outwardly and merges with a pan 51. The sections 43 on each side 35 of the rib 31 define opposed re-entrant portions of the rib 13 and are hereinafter referred to as "re-entrant portions 43".

The leading and trailing edges 47, 49 of the cladding sheets 29*a*, 29*b* are formed as partially-completed ribs in order to facilitate side by side interlocking of adjacent cladding sheets. This feature is a known feature of this type of roof cladding sheet. The invention is not concerned with the side by side engagement of adjacent roof cladding sheets and there is no further description of this feature and the side by side engagement of adjacent roof cladding sheets. Furthermore, the invention is not concerned with stand-alone trailing edges 49 of roof cladding sheets at building edges, roof penetrations or roof openings where overlapping sides are not required.

Figure 2:
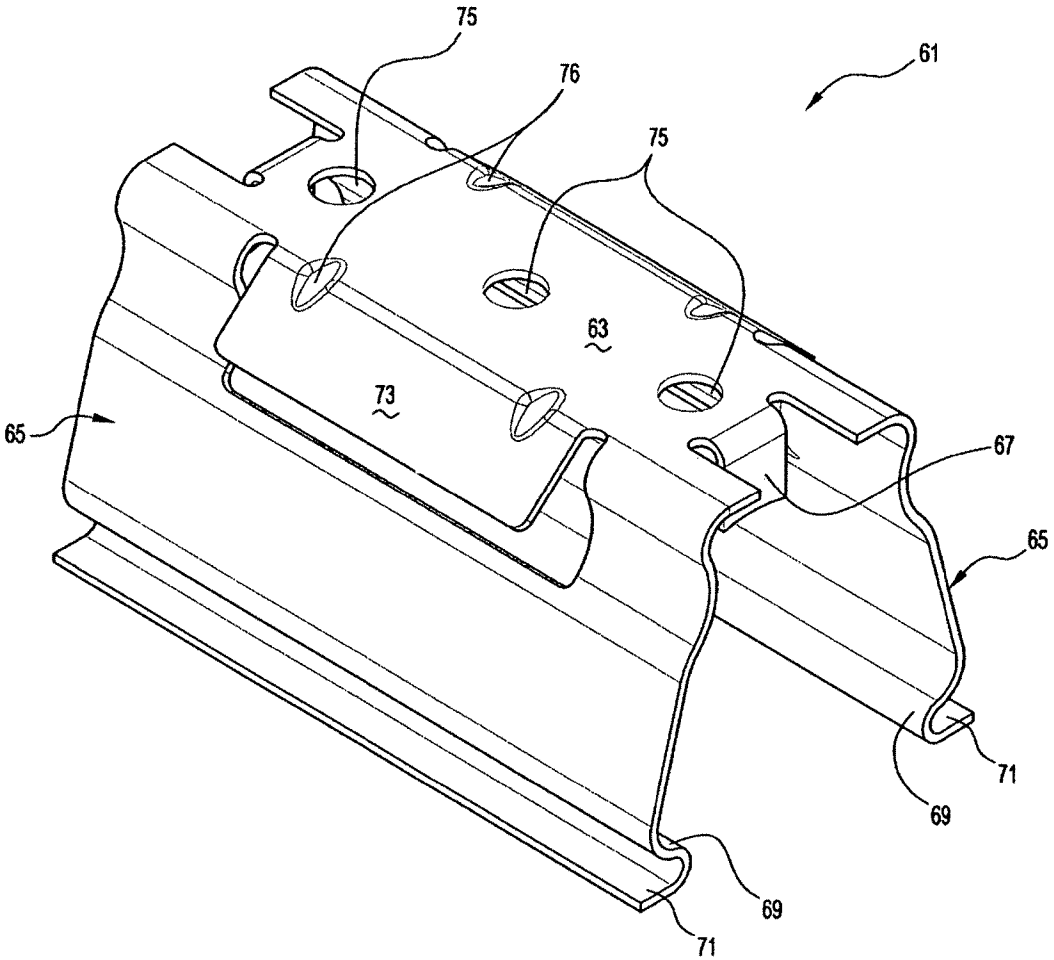
FIG. 2 is a perspective view of one embodiment of an end lap clip in accordance with the present invention that forms part of the end lap system shown in FIG. 1.

As can best be seen in FIG. 2, each end lap clip 61 has a top wall 63 and a pair of legs 65 that extend downwardly from opposite sides of the top wall 63.

The top wall 63 includes formations in the form of a pair of downwardly extending tabs 67 (only one of which can be seen in FIG. 2) at opposite ends of the top wall 63 for contacting an upper section 33 of a rib 31 of the lower roof cladding sheet 29*b* when the clip 61 is positioned on the rib 31. The purpose of the tabs 67 is to space the top wall 63 above the rib 31 so that there is a selected clearance between overlapping cladding sheets 29*a*, 29*b* that is filled by the weather strip 57 to ensure that an effective weather barrier is formed.

The legs 65 are formed with in-turned sections that form re-entrant portions 69. The purpose of the re-entrant portions 69 is to extend into inwardly formed channels 91 defined by the re-entrant portions 43 of the rib 31. The channels 91 are shown in FIG. 3. The arrangement is such that when the clip 61 is fitted over the rib 31 as shown in FIG. 3, which requires initial outward resilient deflection of the legs 65 to move over the sections 41 of the rib 31 and resilient inward return to an original position when the clip 31 is in a lock position on the rib 31, the re-entrant portions 69 and the tabs 67 of the clip 61 contact the rib 31 and cooperate together to lock the clip 61 onto the rib 31.

The shape of the section of each leg 65 of the clip 61 that is above the re-entrant portions 43 of the rib 31 conforms to the shape of the rib 31 of the lower roof cladding sheet 29*b*.

In addition, each leg 65 of the clip 61 includes an out-turned foot 71 which may be extended to contact a pan 51 of the lower roof cladding sheet 29*b* when the clip 61 is fitted over and locked onto the rib 31 of the lower roof cladding sheet 29*b*—as shown in FIG. 3. The feet 71 of this embodiment of the clip 61 are fully-formed feet. In other embodiments (not shown) the feet are not as fully-formed. In other embodiments, there are no feet.

The clip 61 also includes a pair of opposed outwardly extending formations in the form of tabs 73 for engaging opposed re-entrant sections 43 of a rib 31 of the upper sheet 29*a*. The purpose of the tabs 73 is to retain the upper sheet 29*a* on the clip 61 with the upper sheet 29*a* being locked onto the clip 61 by the tabs 73 when a rib 31 of the upper sheet 29*a* is positioned on the clip 61.

The clip 61 also includes openings 75 (see FIGS. 2 and 3) in the top wall 63 to allow fasteners 97 (see FIGS. 1 and 7-9) to be inserted through the openings 75 to secure the clip 31 to the lower sheet 29*a*. The number of openings 75 and type of fastener may be selected as required given uplift and other considerations in roof design.

The clip 61 also includes reinforcing ribs 76 formed in the top wall 63 and the tabs 73 in the corner region for these components. The ribs 76 are pressed into the clip 61. The purpose of the ribs 76 is to strengthen the top wall 63 and the tabs 73, for example to increase the resistance of the tabs 73 bending upwardly and releasing the upper cladding sheet 29*a* in response to uplift forces. FIGS. 2 and 3 shown two parallel ribs 76 on each side of the clip 61 that extending in a direction perpendicular to a length direction of the clip 61. The present invention is not limited to this type and arrangement and number of ribs 76.

The clip 61 shown in the Figures is made from sheet steel. It can readily be appreciated that the clip 61 may be made from any other suitable material. For example, the clip 61 may be formed from a plastics material.

An important consideration for the materials selection and the overall construction of the clip 61 is to form the clip 61 so that the legs 65 act resiliently to snap fit over and thereby lock onto a rib 31 of a lower roof cladding sheet 29*b*.

Figure 4:
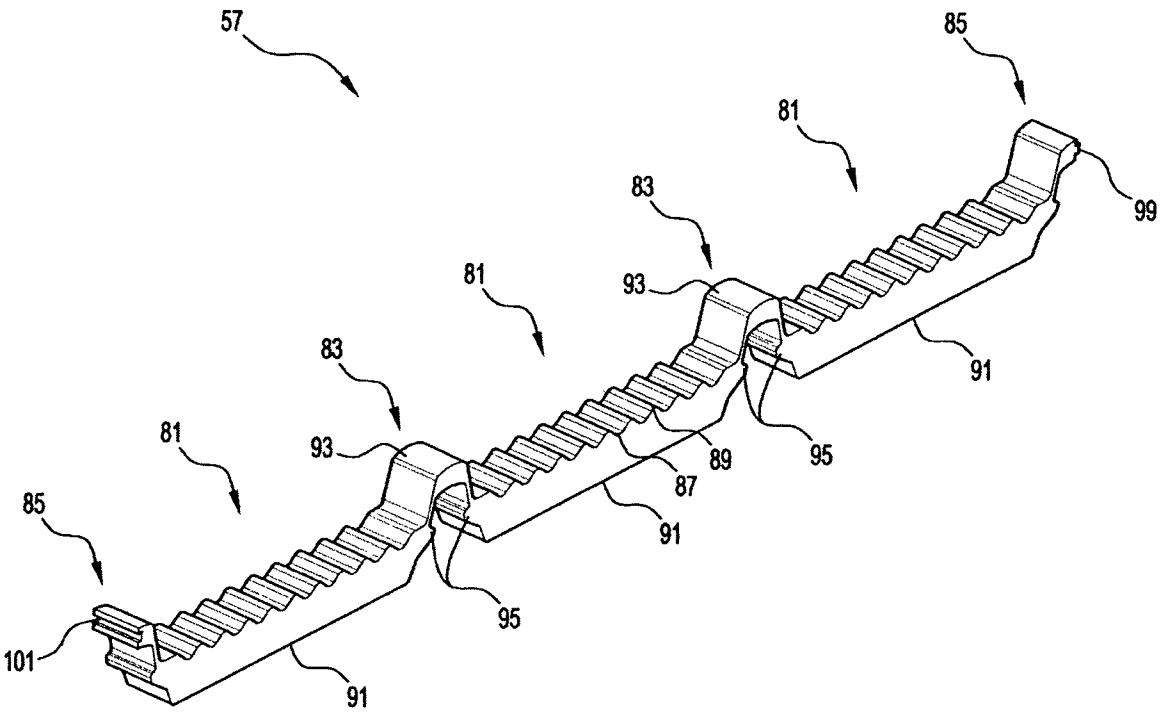
FIG. 4 is a perspective view of one embodiment of a weather strip in accordance with the present invention that forms part of the end lap system shown in FIG. 1.

With reference to FIG. 4, the weather strip 57 of the end lap system shown in FIGS. 2-9 is an elongate member that is formed from a compressible material. The compressible material may be any suitable material. For example, the compressible material may be a foam material. The term "compressible" is understood in the context of the use of the weather strip 57 to form a weather barrier between overlapping roof cladding sheets 29*a*, 29*b*. In other words, the material must be compressible when sandwiched between overlapping cladding sheets 29*a*, 29*b*.

The weather strip 57 includes (a) three pan sections 81, (b) two rib sections 83, and (c) two overlap sections 85. The weather strip 57 may have any suitable number of rib sections 83 and overlap sections 85.

Each pan section 81 has an upper surface having a series of troughs 87 and ridges 89 along the length of the pan section. The upper surface shown in FIG. 4 may be described as being a scalloped surface. The troughs 87 and the ridges 89 result in each pan section 81 having a variable height along the length of the pan section 81. Each pan section 81 is formed having regard to the clearance between upper and lower cladding sheets 29*a*, 29*b* that is set by the tabs 67 of the clip 31 so that the ridges 89 compress to reduce the overall height of the pan section 81 when an upper roof cladding sheet 29*a* is positioned on and engaged with a lower cladding sheet 29*b* in an overlapping relationship and form an effective water barrier. The compressed pan sections 81 fill the gaps between the overlapping pans of the cladding sheets 29*a*, 29*b*. The scalloped upper surface of each pan section 81 makes it possible to use lower forces to position the upper cladding sheet 29*a* onto the lower cladding sheet 29*b* and nevertheless fill the gaps between the overlapping pans 51 of the cladding sheets 29*a*, 29*b* than would be required if the pan sections 81 of the weather strip 57 had a constant height.

Each pan section 81 has a lower surface 91 that has the same profile as the transverse profile of the pan 51 of the lower roof cladding sheet 29*b*. It is noted that there may be situations in which the profile of the lower surface 91 may be different to that of the transverse profile of the pan 51.

The width of the weather strip 57 is selected to be sufficiently wide to minimise any risk of the weather strip 57 being displaced from a selected operative position, for example by being pushed over onto its side, while installing the upper cladding sheet 29*a* onto the lower cladding sheet 29*b* or by being pushed or rolled over during differential thermal movement of the two overlapping roof cladding sheets 29*a*, 29*b*.

Each rib section 83 of the weather strip 57 has an upper surface that has the same profile as the transverse profile of a rib of the upper roof cladding sheet 29*a*. Each rib section 83 also has a lower surface generally identified by the numeral 93 that has the same profile as the transverse profile of the rib 31 of the lower roof cladding sheet 29*b*. One feature of the profile of the lower surface 93 of the rib sections 83 that is useful in the method of installing the upper cladding sheet 29*a* onto the lower cladding sheet 29*b* is that the profile includes inwardly extending formations 95 as a result of conforming to the shape of the re-entrant portions 43 of the sides 35 of the ribs 31 of the cladding sheets 29*a*, 29*b*. In use, these formations 95 extend into the inwardly formed channels 91 defined by the re-entrant portions 43 of the ribs 31 and contribute to holding the weather strip 57 in position on the lower cladding sheet 29*b* during the installation method. More specifically, once the weather strip is positioned on the lower cladding sheet 29*b*, it would be necessary to deflect the formations 95 laterally clear of the channels 91 to dislodge the weather strip 57 from the lower cladding sheet 29*b*.

The overlap sections 85 of the weather strip 57 are at opposite ends of the weather strip 57. The overlap sections 85 are shaped to form rib sections 83 when positioned in end to end relationship with successive weather strips 57. In this regard, one overlap section 85 has a male member 99 and the other overlap section 85 has a complementary female member 101 that facilitates connecting together successive weather strips 57.

FIGS. 5-9 illustrate a sequence of steps to position the upper and lower cladding sheets 29*a*, 29*b* in side by side and end to end relationship as shown in FIG. 1 using the end lap system shown in FIGS. 1 to 4.

Figure 5:
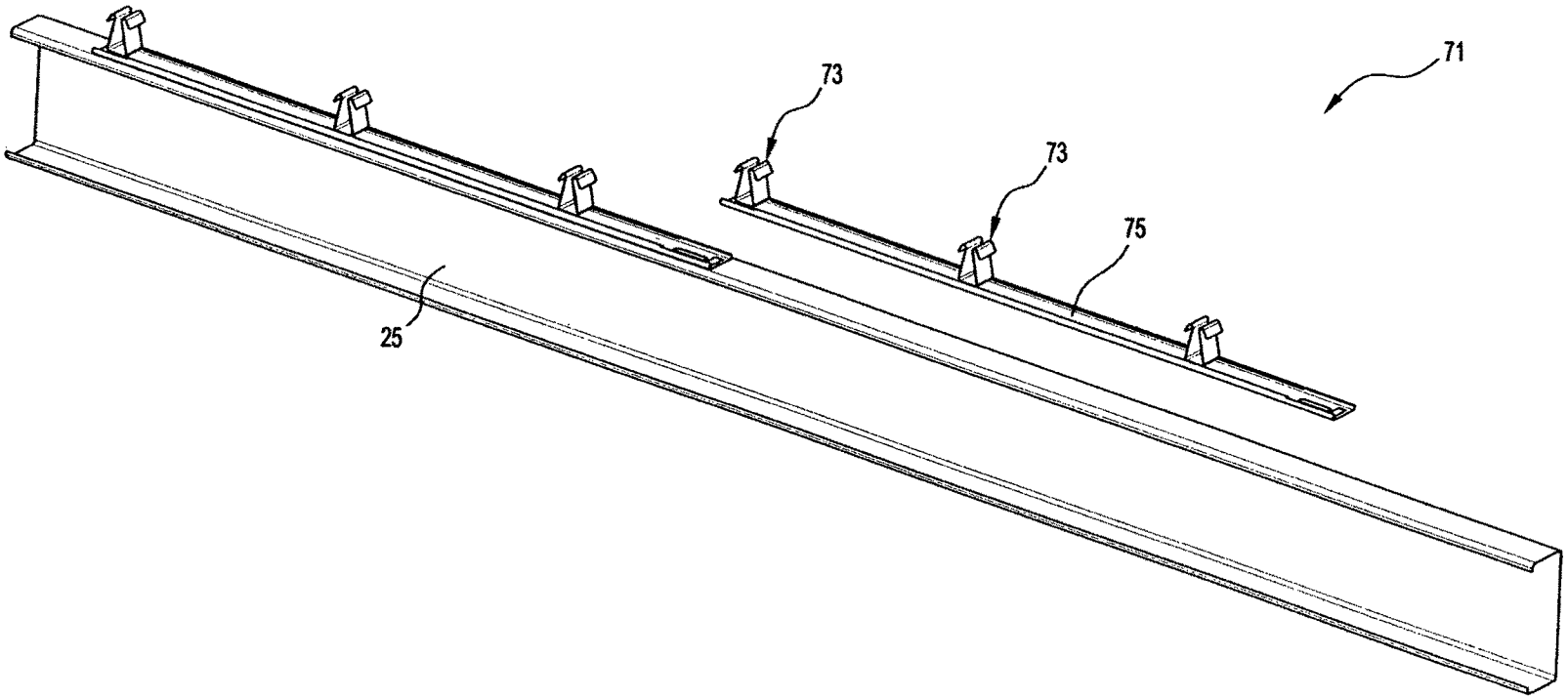
FIGS. 5-9 is a series of perspective views that illustrates a sequence of steps to position the upper and lower cladding sheets shown in FIG. 1 in end to end relationship using the end lap system shown in FIG. 1.
Figure 6:
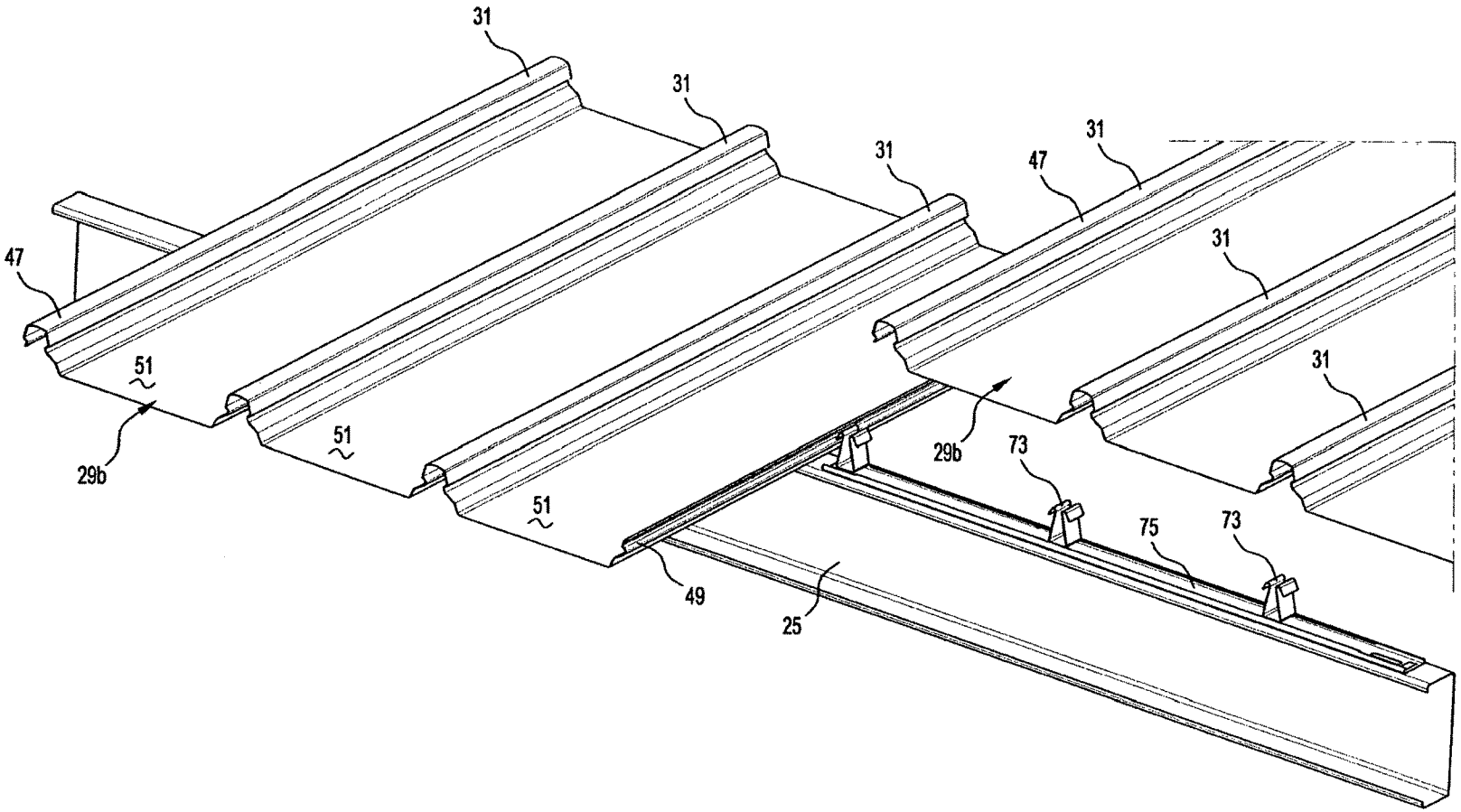
Figure 7:
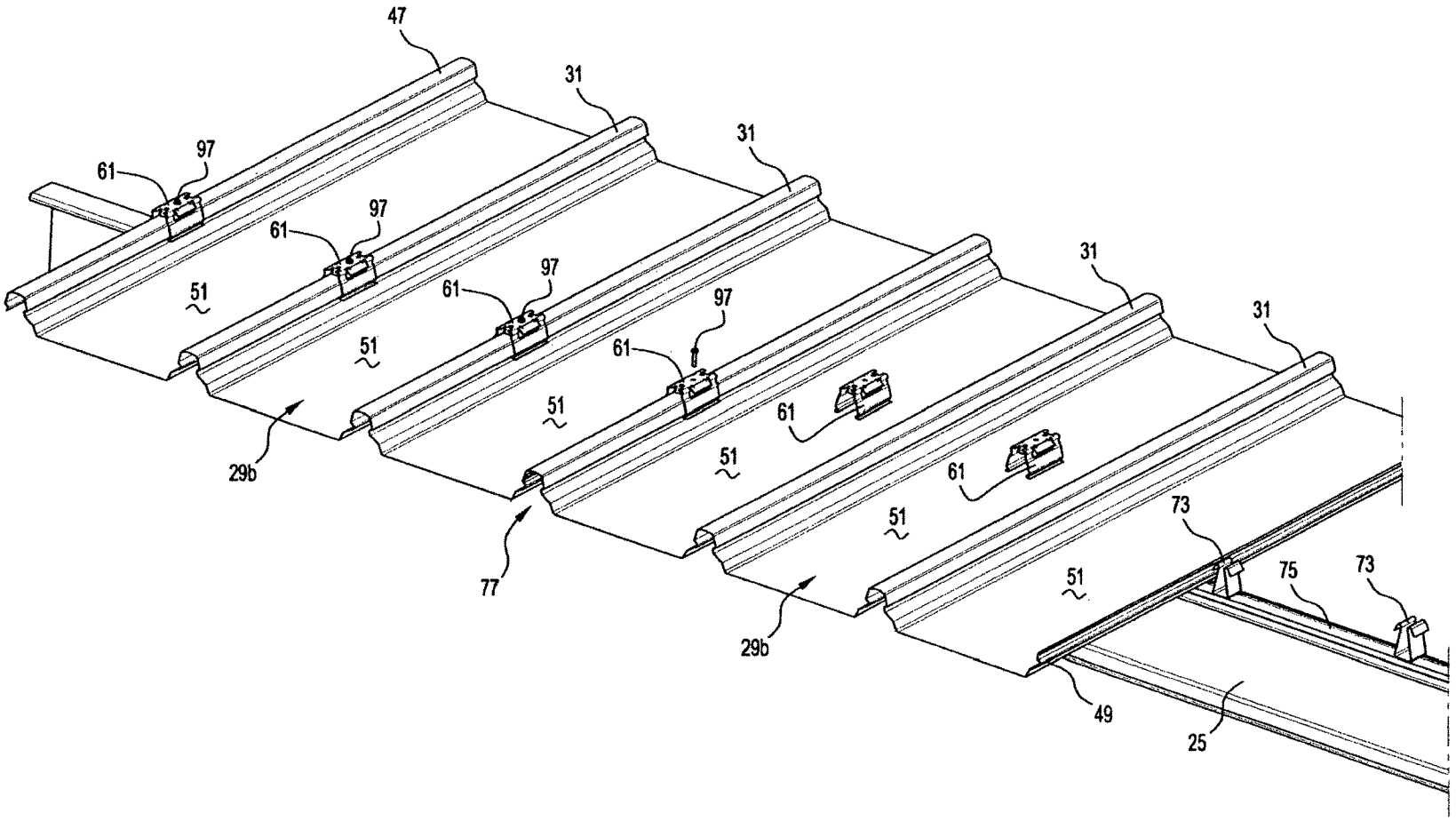
Figure 8:
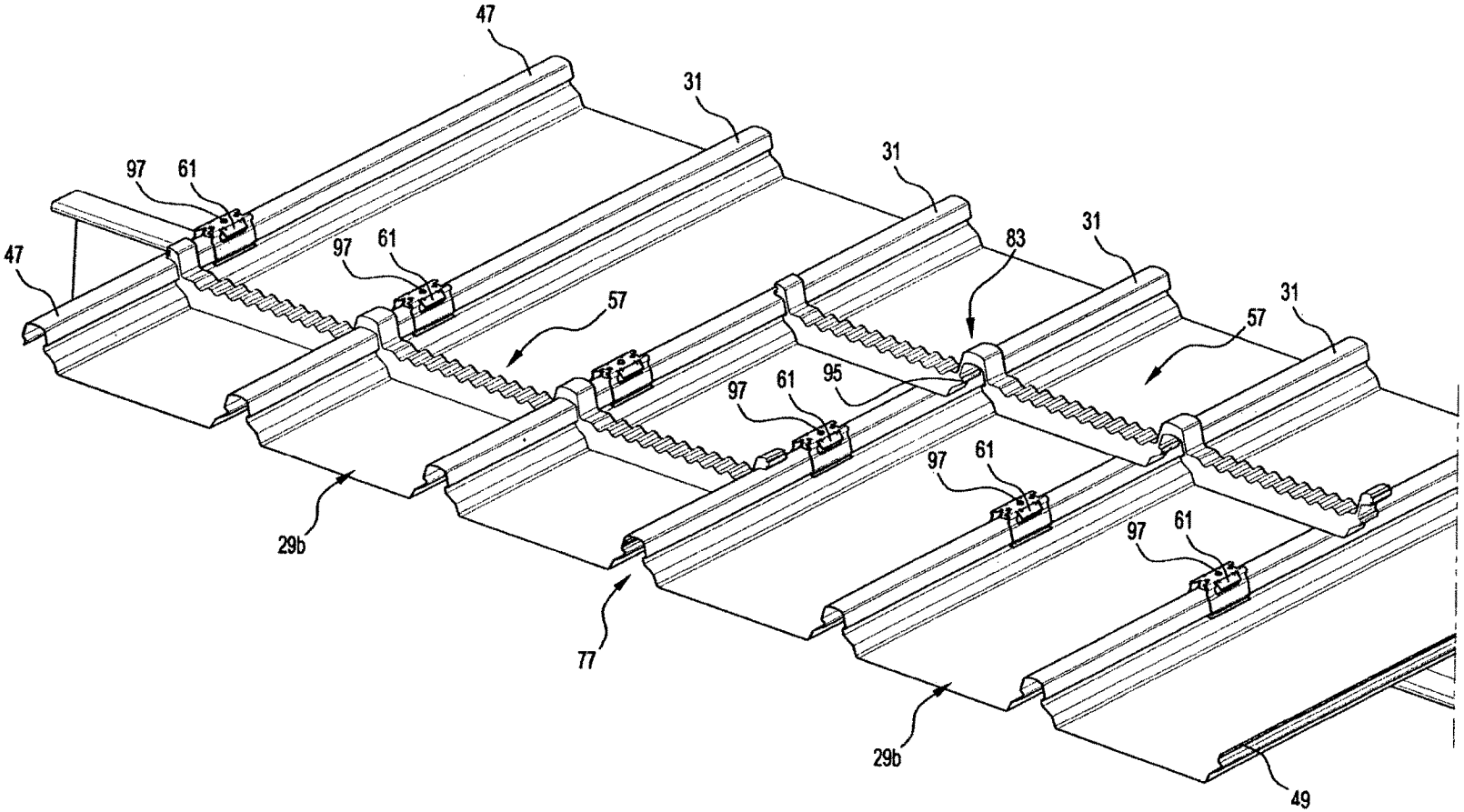
Figure 9:
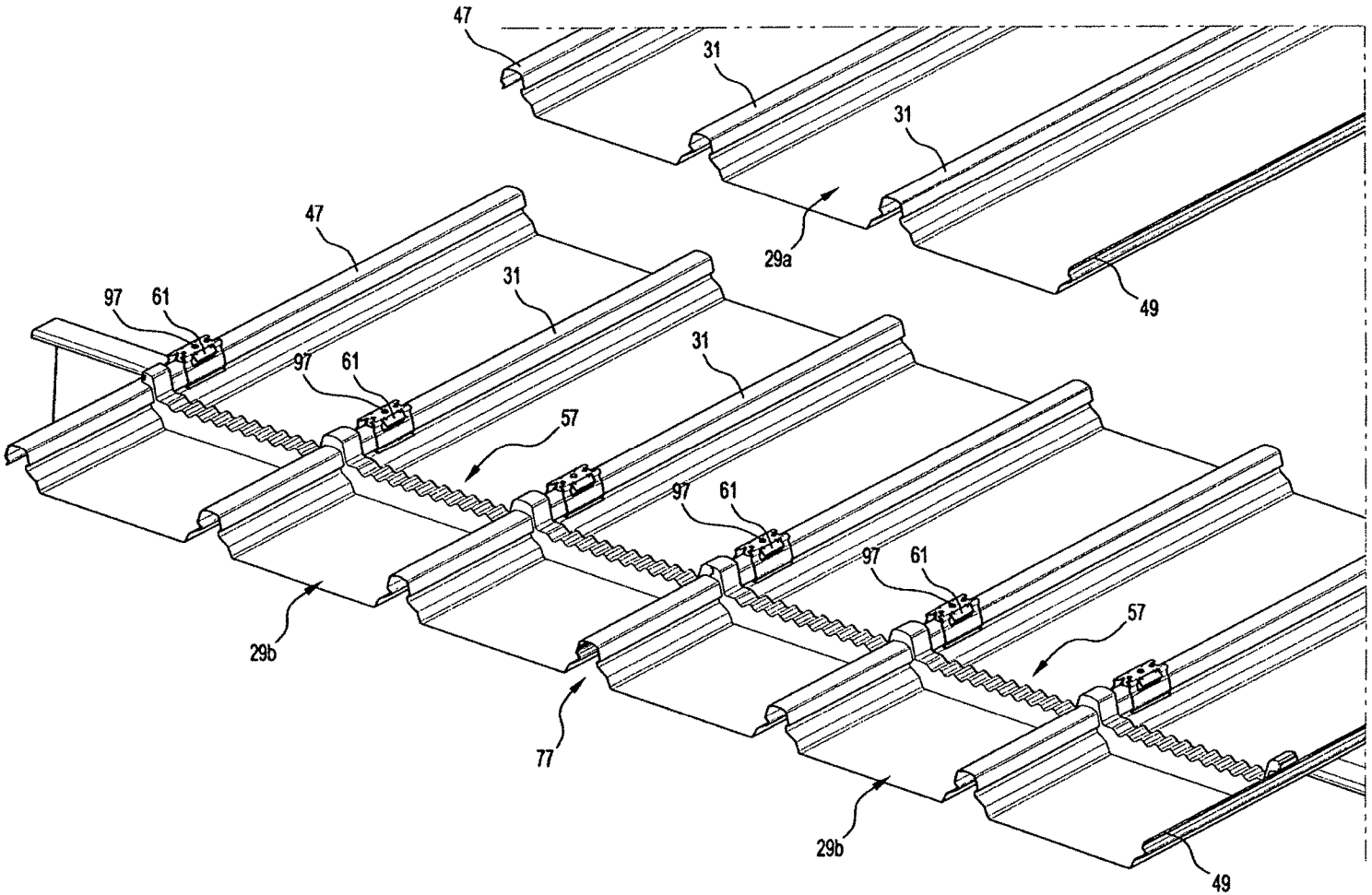
Figure 10:
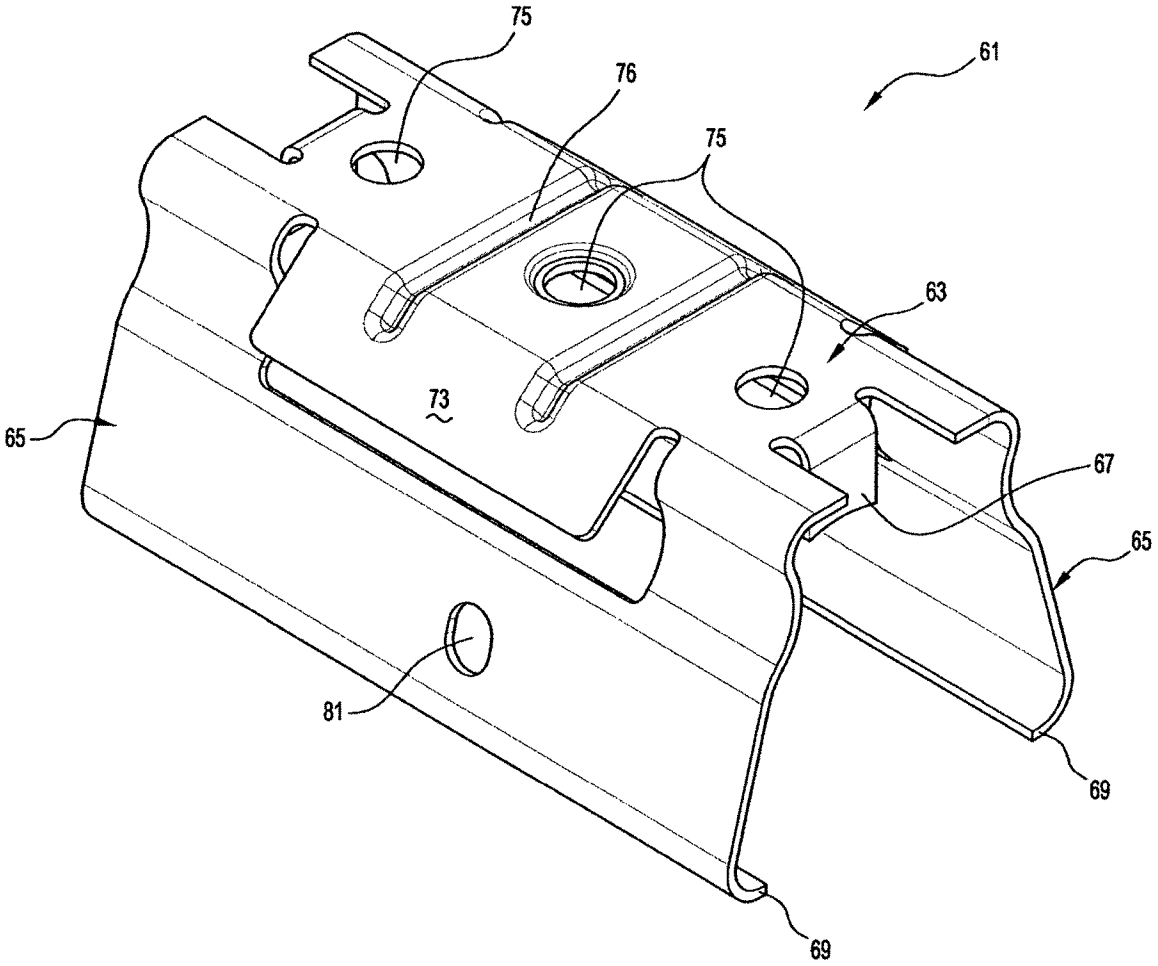
FIGS. 10-14 are respective perspective, side, end, and underside views of another, but not the only other, embodiment of an end lap clip in accordance with the present invention.
Figure 11:
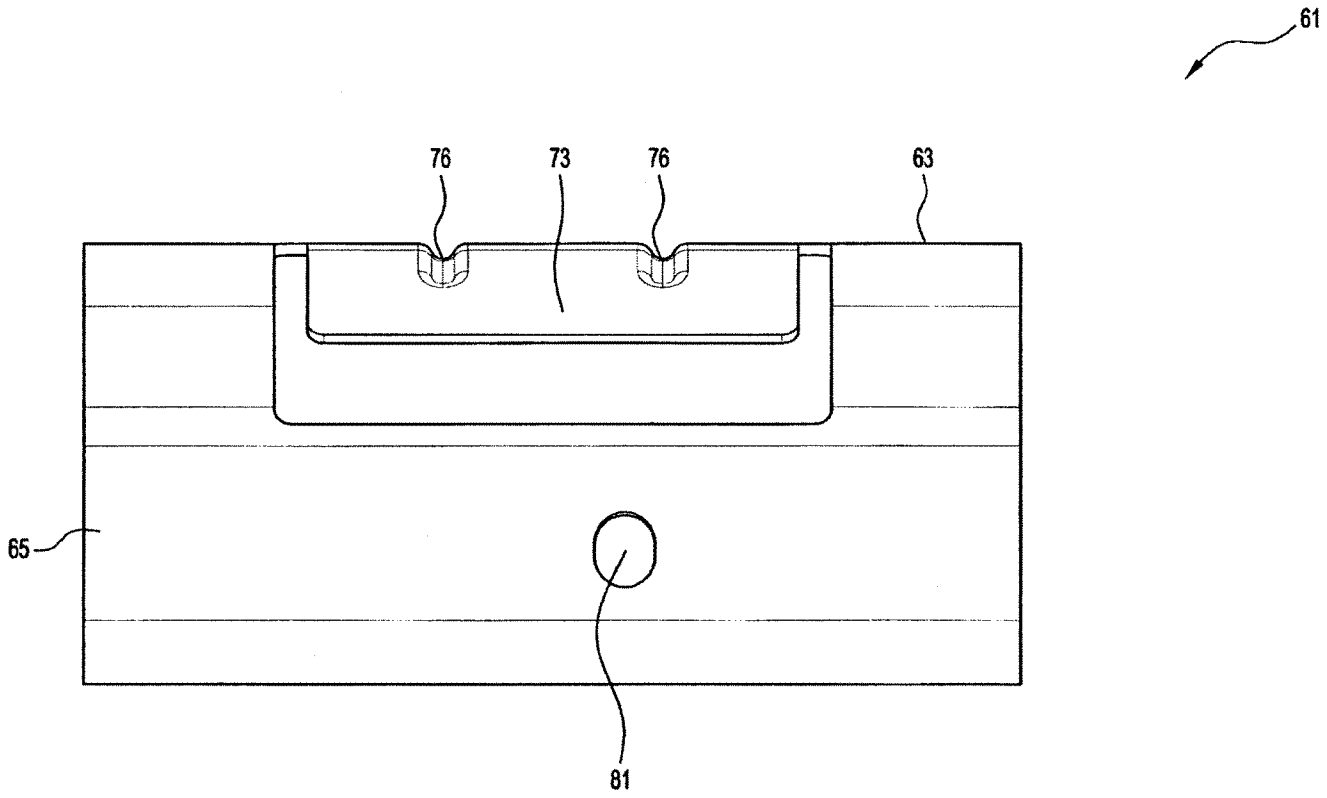
Figure 12:
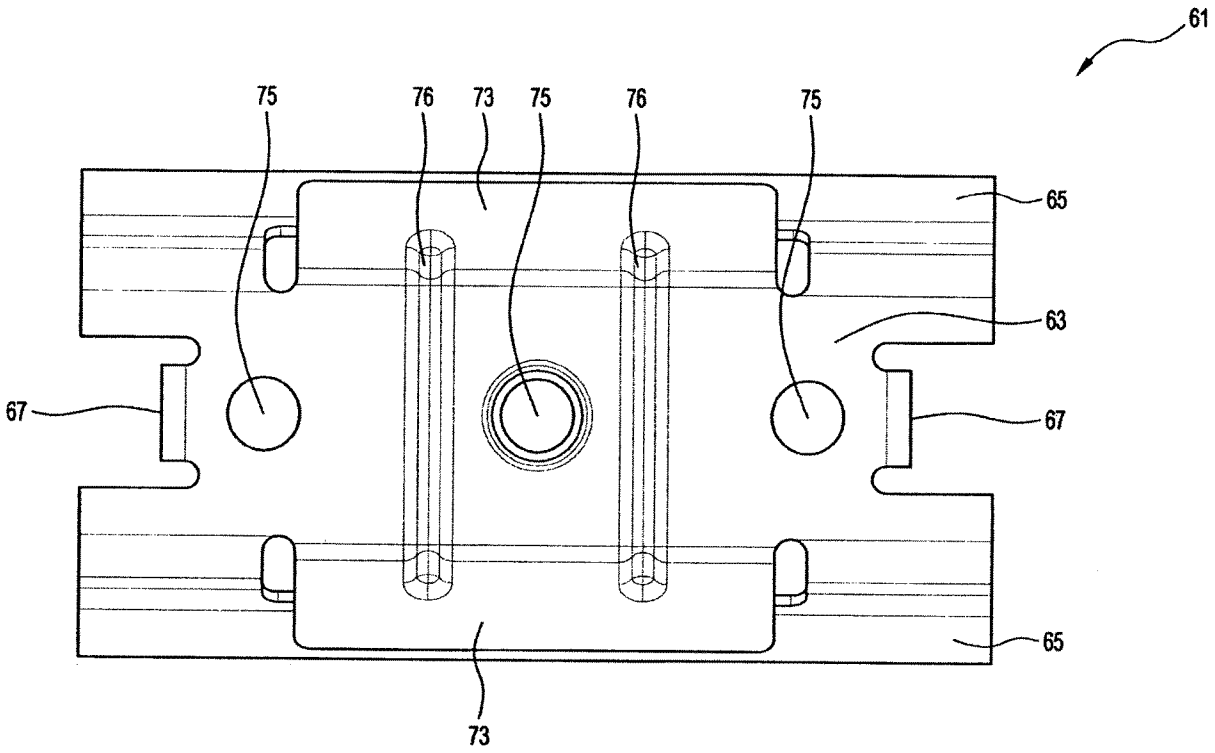
Figure 13:
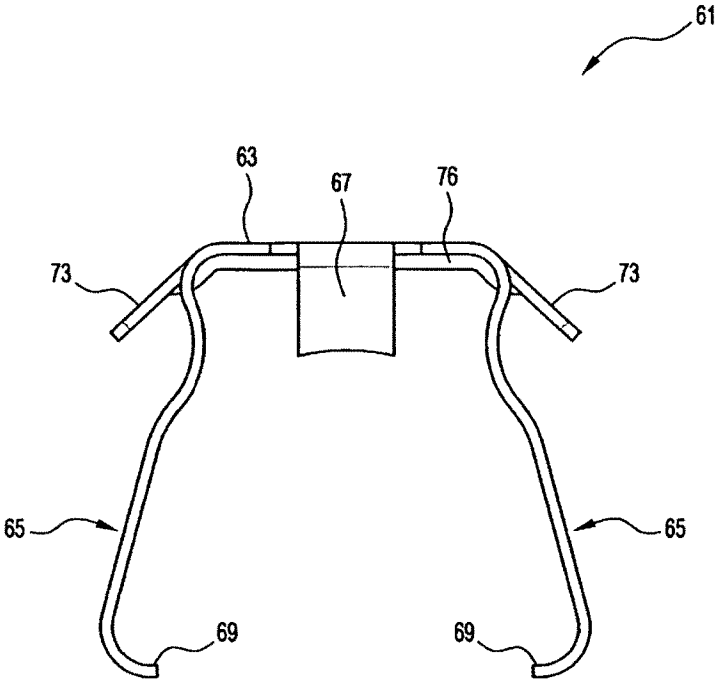

In general terms, the method of installing roof cladding sheets illustrated in the Figures includes the steps of:

(a) laying a plurality of suitable concealed fixing clip, such as conventional concealed fixing clip assemblies 71 comprising clips 73 mounted on straps 75 on a roof purlin 25—see FIG. 5;

(b) laying lower cladding sheets 29*b* (only two of which are shown in FIGS. 6-9) in side by side overlapping relationship onto the roof purlin 25—see FIG. 6;

(c) positioning a plurality of the above-described clips 61 onto the ribs 31 of the lower cladding sheets 29*b* and the overlap ribs 77 formed by the leading and trailing edges 47, 49 of successive lower roof cladding sheets 29*b*—see FIG. 7—with the clips 61 forming a line and being snap-fit on the ribs 31, 77 and positioned either directly above or offset in relation to clips 73;

(d) fastening the clips 61 and the lower cladding sheets 29*b* to the roof purlin 25 by means of fasteners 97 (such as Tek screws) positioned to extend through the openings 75 in the clips 61 and through the underlying roof cladding sheets 29*b*—see FIG. 7;

(e) positioning the weather strips 57 across the lower cladding sheets 29*b* in a continuous line adjacent a lower side of the line of clips 61, with the formations 95 of the rib sections 83 formations 95 extending into the inwardly formed channels 91 defined by the re-entrant portions 43 of the rib 31 and contributing to holding the weather strips 57 in position on the lower cladding sheets 29*b*—see FIG. 8—; and (f) successively laying upper cladding sheets 29*a* onto the lower cladding sheets 29*b* in end to end overlapping relationship and side by side overlapping relationship to form an upper tier of cladding sheets 29*a*, two of which are shown in FIG. 1 and only one of which is shown in FIG. 9, on the lower cladding sheets 29*b*, with the lower ends of the upper cladding sheets 29*a* being retained by the tabs 73 of the clip 61—see FIGS. 1 and 9—and the ends of the upper cladding sheets 29*a* being retained via conventional concealed fixing clip fixing clip assemblies 71 (see FIG. 6) to the next parallel roof purlin 25 (not shown)—and with the construction of the weather strips 57 and the position of the weather strips 57 in relation to the clips 61 facilitating engagement of the upper cladding sheets 29*a* on the clips 61 by acting as cushions that prevent excessive downward force on the clips 61 that could damage the clips 61 and the lower cladding sheets 29*b* when the upper cladding sheets 29*a* are pushed down onto the clips 61.

The method steps (a) to (f) may be repeated as required to form a roof.

The method may include turning up the pans of the lower cladding sheet 29*b* and turning down the pans of the upper cladding sheet 29*a*. The turn-up may be done after step (c) and prior to the installation of the weather strip. The turn-down may be done prior to step (d).

It can readily be appreciated that the above-described end lap system makes it possible to lay roof cladding sheets 29*a*, 29*b* quickly and conveniently in end to end overlapping relationship and side by side overlapping relationship to form a roof.

In particular, being able to lay the lower tier of roof cladding sheets 29*b* directly onto the roof purlin 25 and secure the roof cladding sheets 29*b* to the roof purlin 25 via the fasteners 97 through the clips 61 is a convenient time-saving step in roof construction.

In addition, it is noted that the use of the fasteners 97 to secure the clips 61 to the lower roof cladding sheets 29*b* strengthens the overall roof construction.

In addition, it is noted that there is scope to pre-position the clips 61 and the weather strips 57 on the lower roof cladding sheets 29*b* and thereby speed up the installation time on site.

FIGS. 10-14 are respective perspective, side, end, and underside views of another but not the only other embodiment of an end lap clip 61 in accordance with the present invention. The clip 61 shown in these Figures is very similar to the clip 61 shown in FIGS. 2 and 3 and the same reference numerals are used to describe the same features.

The main differences between the two embodiments are as follows:

(a) the reinforcing ribs 76 in the FIGS. 10-14 embodiment extend all of the way across the top wall 63 and the tabs 73 and therefore are more substantial ribs than the ribs 76 of the FIGS. 2 and 3 embodiment; and (b) the FIGS. 10-14 embodiment includes an opening 81 in each leg 65 to allow fasteners 97 to be inserted through the openings 81 to secure the clip 61 and the lower cladding sheet 29*b* together or to secure the clip 61 and the lower sheet 29*b* to a roof purlin 25.

The openings 81 are off-set with respect to the openings 75 so that there is no interference between the fasteners.

Figure 14:
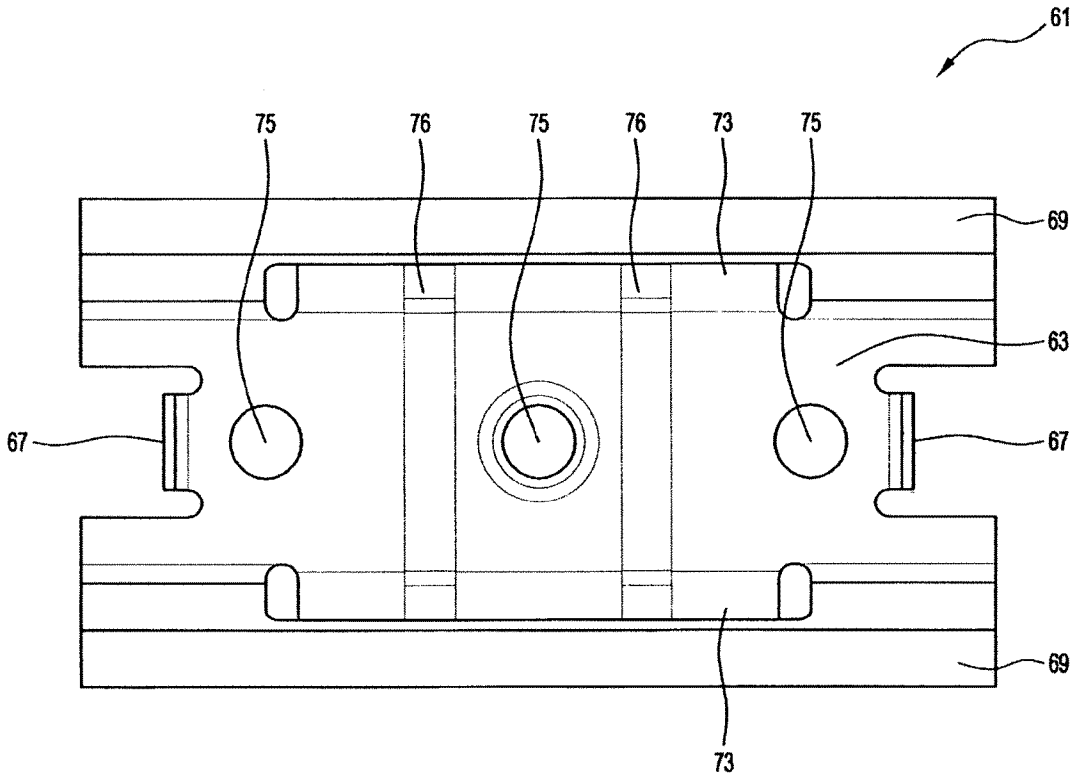
Figure 15:
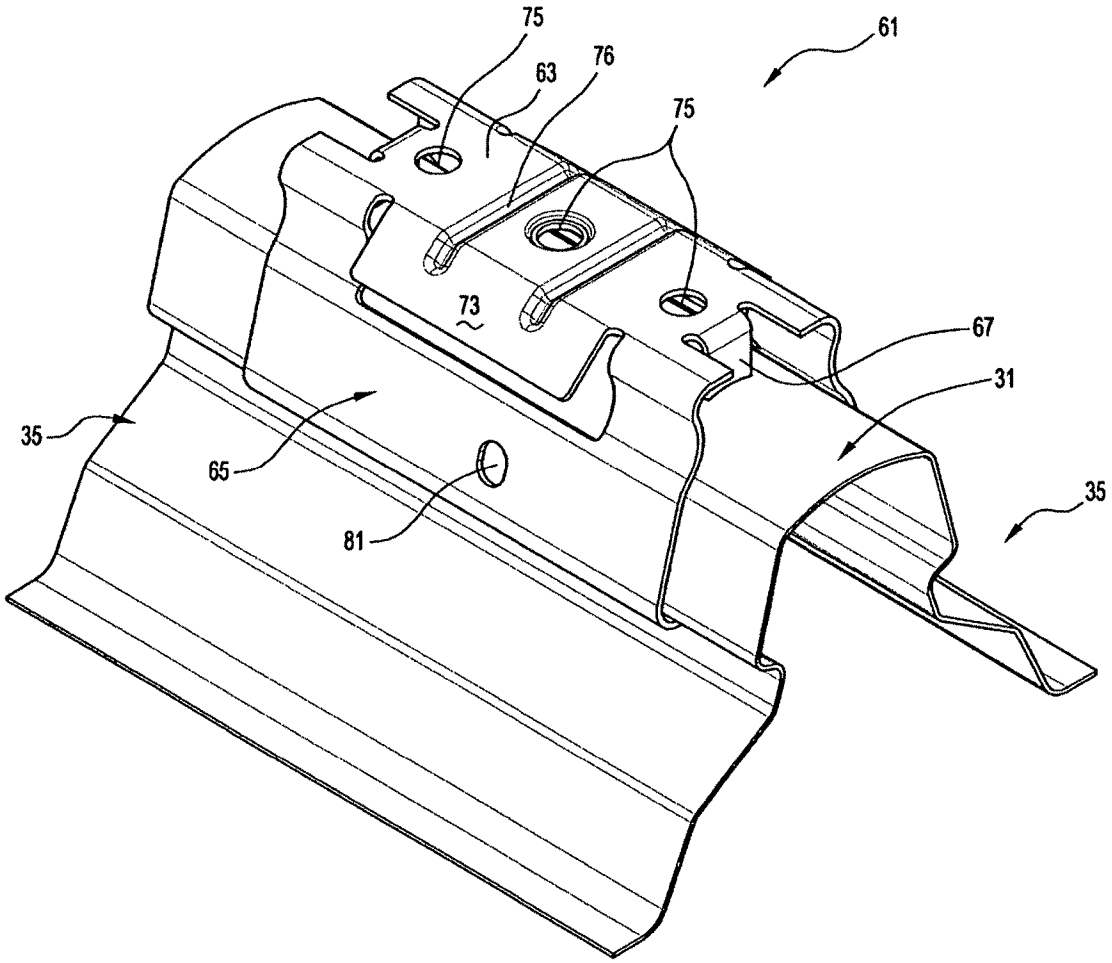
FIG. 15 is a perspective view of the embodiment of the end lap clip shown in FIGS. 10-14 positioned on a rib of a lower roof cladding sheet.

FIG. 15 is a perspective view of the embodiment of the end lap clip shown in FIGS. 10-14 positioned on a rib 31 of a lower roof cladding sheet 29*b*. FIGS. 3 and 14 are similar Figures and the description of the FIG. 3 arrangement is equally applicable to the FIG. 15 arrangement.

Figure 16:
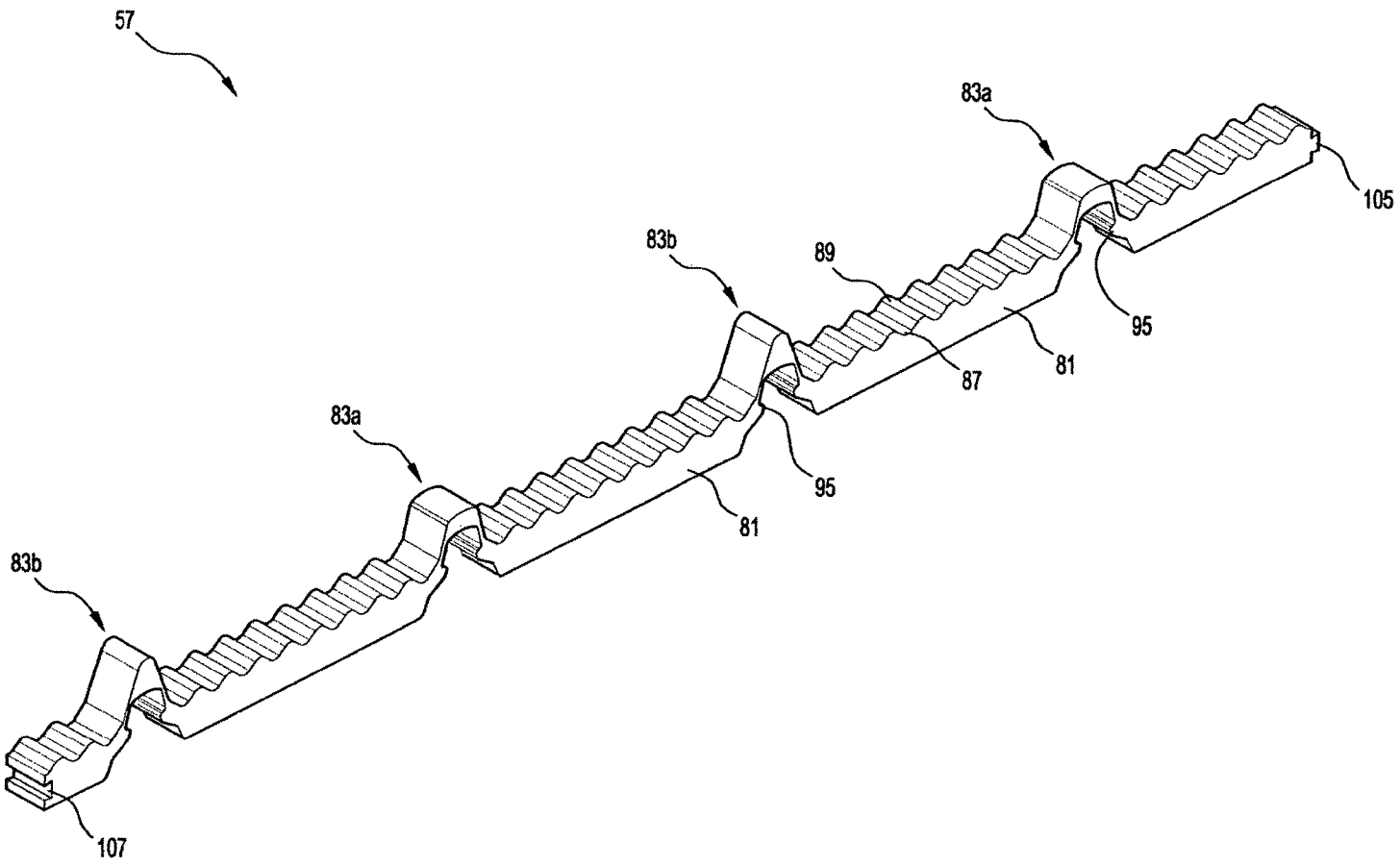
FIG. 16 is a perspective view of another, but not the only other, embodiment of a weather strip in accordance with the present invention.

The embodiment of the weather strip 57 shown in FIG. 16 is similar in terms of basic construction to the embodiment of the weather strip 57 shown in FIG. 4. One main difference is the number and the form of the profiles of the rib sections 83*a* and 83*b* and the number of pan sections 81. Another main difference is the end sections that allow successive weather strips 57 to be connected together to form a continuous line.

With reference to FIG. 16, as is the case with the FIG. 4 weather strip 57, the weather strip 57 is an elongate member that is formed from a compressible material.

The weather strip 57 includes (a) four pan sections 81, (b) four rib sections 83*a*, 83*b*, and (c) two end sections that allow successive weather strips 57 to be connected together to form a continuous line. The weather strip 57 may have any suitable number of rib sections 83 and overlap sections 85.

With reference to FIG. 16, the end sections of the weather strip 57 are part of pan sections 81 (as opposed to forming a rib 77 in the case of the FIG. 4 embodiment) have tongue 105 and groove 107 formations that allow successive weather strips 57 to be connected together to form a continuous line.

Each pan section 81 has an upper surface having a series of troughs 87 and ridges 89 along the length of the pan section 81. The upper surface shown in FIG. 16 may be described as being a scalloped surface. The pan sections 81 are substantially the same as the pan sections 81 of the weather strip shown in FIG. 4 and function as described in relation to FIG. 4.

As is the case with the FIG. 4 weather strip 57, the width of the weather strip 57 shown in FIG. 16 is selected to be sufficiently wide to minimise any risk of the weather strip 57 being displaced from a selected operative position, for example by being pushed over onto its side, while installing an upper cladding sheet 29*a* onto a lower cladding sheet 29*b* or by being pushed or rolled over during differential thermal movement of the two overlapping roof cladding sheets 29*a*, 29*b*.

The rib sections 83*a* and 83*b* alternate along the length of the weather strip 57.

The two rib sections 83*b* shown in FIG. 16 are inverted V-shaped sections. The lower surface of each rib section 83*b* has the same profile as the transverse profile of the ribs 31 of a lower cladding sheet 29*b*, including having inwardly extending formations 95 as a result of conforming the profile to the shape of the re-entrant portions 43 of the sides 35 of the ribs 31. The upper surface of each rib section 83*b* is V-shaped. The rib sections 83*b* are formed to engage the ribs 31 of a lower cladding sheet 29*b* and are sufficiently large to completely fill a gap between the ribs 31 of lower and upper cladding sheets 29*a*, 29*b* when the cladding sheets are installed on a roof in overlapping end lap relationship—this is evident from FIG. 18 (even though the Figure shows the weather strip 57 and the upper and lower cladding sheets 29*a*, 29*b* spaced apart). The V-shape of the upper surface of the rib sections 83*b* facilitates compression of the material to completely fill the gap.

The two rib sections 83*a* also has the same profile as the transverse profile of the ribs 31 of a lower cladding sheet 29*b*, including having inwardly extending formations 95 as a result of conforming the profile to the shape of the re-entrant portions 43 of the sides 35 of the ribs 31. However, the upper surface of each rib sections 83*a* is curved and the overall size of the rib section 83*b* is smaller than that of the contained volume of the ribs 31 of the upper cladding sheets 29*a*—this is evident from FIG. 18. As a consequence, the rib sections 83*a* do not completely fill a gap between the ribs 31 of lower and upper cladding sheets 29*a*, 29*b* when the cladding sheets are installed on a roof in overlapping end lap relationship. This feature allows air to flow through the remaining part of the gaps from one side to the other side of the weather strip 57, as is discussed further below.

Figure 17:
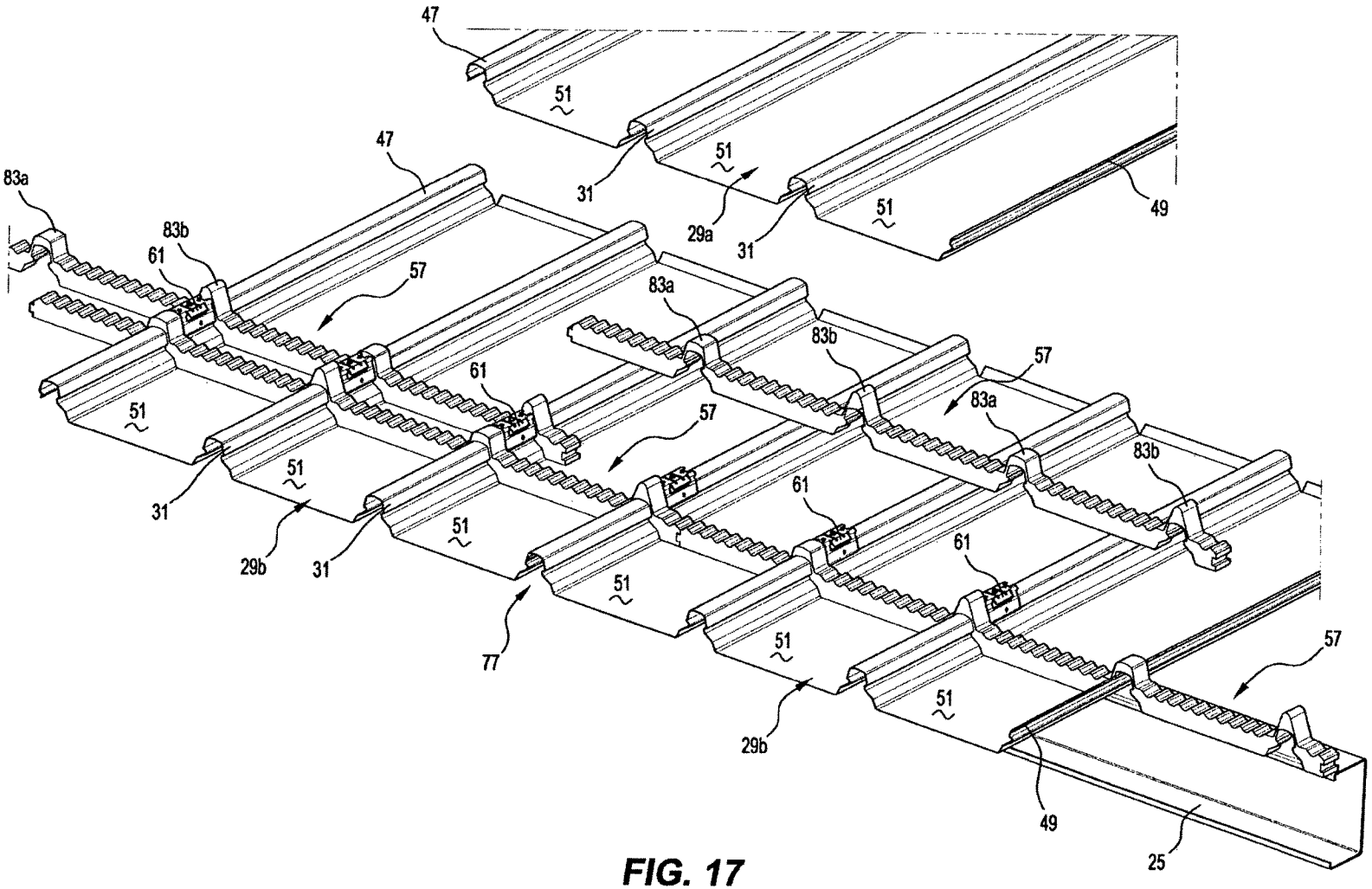
FIG. 17 is a perspective view of a part of another, but not the only other, embodiment of an end lap system in accordance with the present invention which includes two continuous lines of the weather strip shown in FIG. 16.
Figure 18:
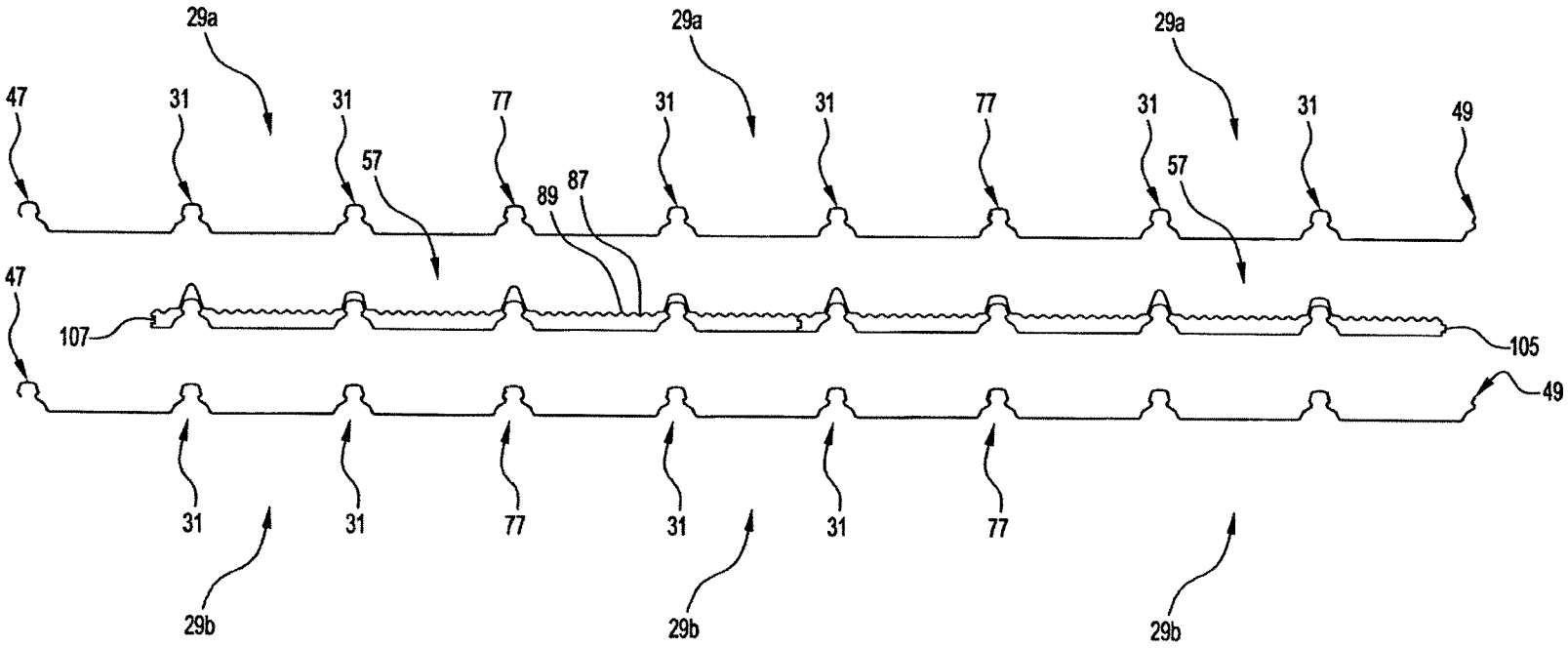
FIG. 18 is an exploded vertical cross-section through the end lap system partially shown in FIG. 17 that illustrates the relative positions of one of the two lines of the weather strip shown in FIG. 16.
Figure 19:
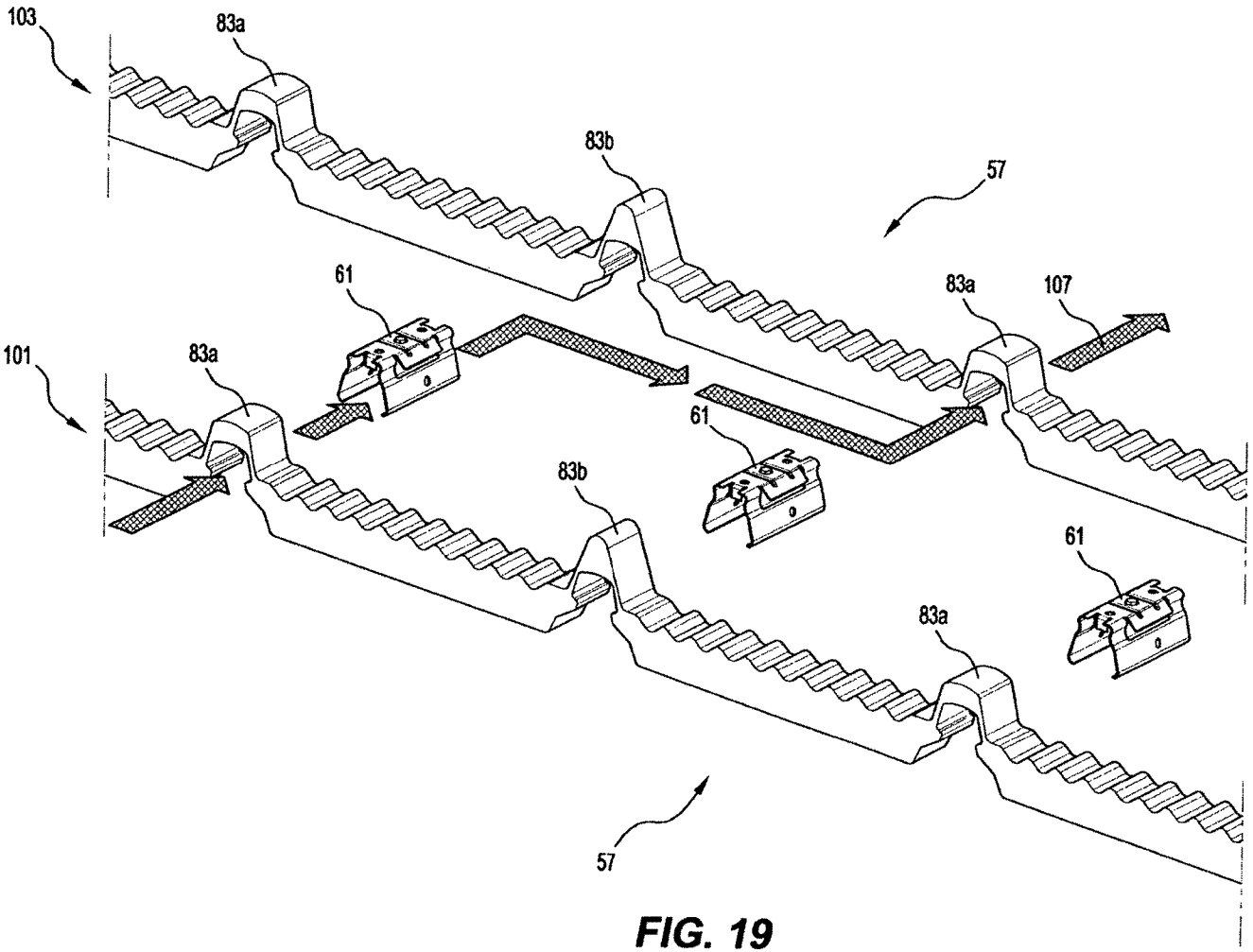
FIG. 19 is a diagrammatic perspective view of a part of the end lap system shown in FIG. 16 which focuses on the arrangement of the two continuous lines of weather strips shown in FIG. 16.

FIG. 17 is a perspective view of a part of another embodiment of an end lap system in accordance with the present invention which focuses on the arrangement of two continuous lines 101, 103 of weather strips 57. FIGS. 9 and 17 are similar Figures and the description of the FIG. 9 arrangement is relevant to the FIG. 17 arrangement. FIG. 19 is a diagrammatic perspective view that focuses only on the lines of weather strips 57. FIG. 18 is an exploded vertical cross-section through the end lap system partially shown in FIG. 17 that illustrates the relative positions of one of the two lines of weather strips 57 shown in FIG. 16.

With reference to FIGS. 17 and 19, the two lines of weather strips 57 are positioned on opposite sides, i.e. a lower side and an upper side, of a line of clips 61 that are mounted to lower cladding sheets 29*b* that in turn are mounted to an underlying support structure in the form of a roof purlin 25. The Figure shows a plurality of the weather strip 57 of FIG. 16. It can readily be appreciated that the weather strip may be the FIG. 4 weather strip or any other suitable weather strip.

The weather strips 57 in one line are off-set longitudinally with respect to the weather strips 57 in the other line. As a consequence, the rib sections 83*a* are not aligned and the rib sections 83*b* are not aligned. This is evident from FIGS. 18 and 19. This off-set feature further contributes to the venting feature of the rib sections 83*a* of the weather strips 57. In particular, the off-set feature forces air flow in a tortuous path indicated by the line 107—the tortuous path is indicated by the arrow in FIG. 19. The effect of the tortuous flow path is to ensure that the air flow minimises condensation in the space between upper and lower cladding sheets and between the lines of weather strips 57.

Many modifications may be made to the embodiment of the invention described herein without departing from the spirit and scope of the invention.

By way of example, whilst the drawings illustrate roof cladding sheets 29*a*, 29*b* having two ribs 31 and three pans 51, it can readily be appreciated that the invention is not limited to this arrangement and extends to cladding sheets have any suitable numbers of ribs and pans.

By way of further example, whilst the drawings illustrate one clip 61 per rib 31, it can readily be appreciated that the invention is not limited to this arrangement and extends to arrangements in which there are two or more clips 61 (with or without fastener 97) per rib 31. This may be desirable in high wind regions.

By way of further example, whilst the drawings illustrate two roof cladding sheets 29*a*, 29*b* in end to end relationship, it can readily be appreciated that the invention extends to laying successive roof cladding sheets on the second and subsequent roof cladding sheets using the end lap system.

By way of further example, whilst the drawings illustrate arrangements in which the fasteners 97 fasten the clips 61 to the lower cladding sheets 29*b* only, it can readily be appreciated that the invention extends to arrangements in which the fasteners 97 fasten the clips 61 and the lower cladding sheets 29*b* to the roof purlins 25. This makes it possible to avoid separately securing the lower cladding sheets 29*b* to roof purlins 25, for example using conventional concealed fixing clips. Being able to lay the tiers of roof cladding sheets 29*b* directly onto the roof purlins 25 and secure the roof cladding sheets 29*b* to the roof purlins 25 via the fasteners 97 through the clips 61 is a convenient time-saving step in roof construction.

By way of further example, whilst the drawings illustrate arrangements that includes clips 61 and weather strips 57 that at least partially fill the gap between the upper and lower roof cladding sheets 29*a*, 29*b*, it can be appreciated that the invention is not limited to this arrangement and extends to arrangements that do not include weather strips and the main objective is to support upper and lower roof cladding sheets 29*a*, 29*b* in overlapping relationship, via the clips 61, with a gap that allows air flow for ventilation purposes. With this arrangement, it may be necessary to include a barrier to prevent entry of birds or vermin through the gap.

By way of further example, whilst the drawings and the above description of the invention focus on the use of the clips 61 for retaining upper and lower roof cladding sheets together at the end laps of the sheets, it can readily be appreciated that the clips can be used in other applications, such as clips for retaining equipment (e.g. solar panels) on roofs.

By way of further example, whilst the drawings and the above description disclose that the upper pan sections 81 of the weather strips 57 have a scalloped upper surface, it can readily be appreciated that the invention extends to other variable height profiles that facilitate compression of the upper surface when an upper cladding sheet is positioned on a lower cladding sheet with the weather strip sandwiched between the sheets.

By way of further example, whilst the drawings and the above description disclose that the weather strips 57 have particular dimensions, it can readily be appreciated that the invention extends to weather strips of any suitable dimensions.

In the claims which follow, and in the preceding description, except where the context requires otherwise due to express language or necessary implication, the word "comprise" and variations such as "comprises" or "comprising" are used in an inclusive sense, i.e. to specify the presence of the stated features but not to preclude the presence or addition of further features in various embodiments of the end lap system and components of the end lap system as disclosed herein.

The invention claimed is:

1. A clip for holding together an upper roof cladding sheet and a lower roof cladding sheet in an end lap relationship on a roof with the upper cladding sheet overlapping the lower cladding sheet, and with the clip being formed (a) to fit over and lock onto a rib of the lower cladding sheet and (b) to retain the upper cladding sheet on the clip, with the clip including a top wall, a pair of legs that extend downwardly from opposite sides of the top wall and an opening in the top wall to allow a fastener to be inserted through the opening to secure the clip and the lower cladding sheet together or to secure the clip and the lower cladding sheet to a support structure or to each other, with the top wall including a formation for contacting an upper section of the rib of the lower cladding sheet to space the top wall above the rib, with the formation being in the form of a pair of downwardly extending tabs at opposite ends of the top wall and with the legs including re-entrant portions that are formed to extend into inwardly formed channels defined by re-entrant portions of the rib of the lower cladding sheet, and with the leg re-entrant portions and the top wall formation being formed to contact the rib and cooperate together to lock the clip onto the rib when the clip is fitted over the rib.

2. The clip defined in claim 1 including a pair of opposed outwardly extending formations for engaging opposed re-entrant sections of a rib of the upper cladding sheet to retain the upper sheet on the clip with the upper cladding sheet being locked onto the clip when the rib of the upper cladding sheet is positioned on the clip.

3. The clip defined in claim 1 including one or more than one reinforcing rib in the top wall.

4. The clip defined in claim 3 wherein the reinforcing rib or ribs extend across the top wall from one leg of the pair of legs to the other leg of the pair of legs and partly into the formations for engaging opposed internal re-entrant sections of the rib of the upper cladding sheet.

5. An end lap system of a roof comprising a plurality of upper roof cladding sheets, a plurality of lower roof cladding sheets, and a plurality of clips as defined in claim 1 holding together the upper cladding sheets and lower cladding sheets in side by side overlapping relationship and end lap relationship on the roof with the upper cladding sheets overlapping the lower cladding sheets, with the upper cladding sheets and lower cladding sheets having ribs and pans, and with the clips being retained on ribs of the lower cladding sheets and retaining the upper cladding sheets on the clips.

6. The system defined in claim 5 including a continuous line of elongate weather strips in a space between the upper cladding sheets and the lower cladding sheets on one side of the clips, each weather strip being formed from a compressible material and including a pan section that at least partially fills a gap between overlapping pans of a pair of overlapping cladding sheets, with the pan section including an upper surface having a series of troughs and ridges along the length of the pan section that provides the pan section with a variable height along the length of the pan section, whereby the ridges of the pan section are compressed between the pans of the overlapping pair of cladding sheets, and another continuous line of elongate weather strips at least partially filling the gap between the overlapping pans of the pair of overlapping cladding sheets on the opposite side of the clips.

7. The system defined in claim 6 wherein the weather strips of one line are longitudinally off-set with respect to the weather strips of the other line so that there is not a direct line between the at least partially filled gaps between overlapping pairs of ribs of the cladding sheets on opposite sides of the line of clips so that there is a resultant tortuous path for air flow that minimises condensation in the space between the upper and lower cladding sheets.

* * * * *